United States Patent [19]

Shalvi et al.

[11] Patent Number: 4,751,498

[45] Date of Patent: Jun. 14, 1988

[54] SINGLE-WIRE LOOP ALARM SYSTEM

[75] Inventors: Ram Shalvi, Teaneck; Rudor M. Teich, South Orange; Keith Guillaume, Edison, all of N.J.

[73] Assignee: Tracer Electronics, Inc., S. Orange, N.J.

[21] Appl. No.: 838,595

[22] Filed: Mar. 11, 1986

[51] Int. Cl.[4] ..... G08B 25/00; G08B 26/00

[52] U.S. Cl. ..... 340/524; 340/505; 340/506; 340/508; 340/511; 340/525; 340/534; 340/537; 340/825.07

[58] Field of Search ..... 340/524, 525, 506, 505, 340/504, 508, 509–514, 518, 531, 533, 534, 536, 537, 825.06–825.16, 325.54

[56] References Cited

U.S. PATENT DOCUMENTS

| | | | |
|---|---|---|---|
| 4,067,008 | 1/1978 | Sprowls, III | 340/505 |
| 4,228,424 | 10/1980 | LeNay et al. | 340/506 |
| 4,491,828 | 1/1985 | Galvin et al. | 340/505 |
| 4,536,748 | 8/1985 | Tonello | 340/505 |
| 4,612,534 | 9/1986 | Buehler et al. | 340/505 |
| 4,613,848 | 9/1986 | Watkins | 340/505 |

*Primary Examiner*—Donnie L. Crosland
*Attorney, Agent, or Firm*—Gottlieb, Rackman & Reisman

[57] ABSTRACT

A single-wire loop alarm system in which an identification module is placed across each alarm switch. Any module which is across an open switch is powered by the loop current and, in response to a pulse count in the loop representing its address, changes the loop impedance in order to report on its status. The loop current may alternate in direction so that oppositely poled modules may be used, thus allowing a larger number of powered modules to accommodated at the same time.

110 Claims, 16 Drawing Sheets

INSTALLED PANEL
ARMED
+6
EOL
SW1
SW2
SW3
SWN
IDM1
IDM2
IDMN
SWITCHER
+35
DS4
DS3
K1
μP 8749
D7
P27
D6
T1
GND
P23
P24
R
P10-P17
P20-P21
P22
D0
T0
D2
D1
XTAL1
XTAL2
DI
DO
CLK
CHO
CHI
CS
ADC 0852
TIMERS
POWER SUPPLY
+35
+5
TRACER PANEL
STATUS
LOCATION
ALARM
ARMED
BYPASS
HISTORY
DS1-DELAY
DS2-POL
TEST POINT
100
10
12
14
16
18
20
22
24
26
28
30
32
34
36
38
40
42
50
52
54
56
58

CODE STORE AND DETECT CIRCUITRY
332
CLOCK LEVEL DETECTOR WITH HYSTERISIS
330
MISSING CLOCK PULSE DETECTOR
334
POWER-ON RESET
336
CLOCK GLITCH SUPPRESSION CIRCUIT
320
CLK1
CLK1
RST
RST2
RST1
338
340
342
ZP
318
322
324
316
308
312
314
CLK
VDD OUT
VSS
pads
310
INTEGRATED CIRCUIT
304
306
302
300
100
SWN
LOOP

CODE STORE AND DETECT CIRCUITRY

FIG. 13E
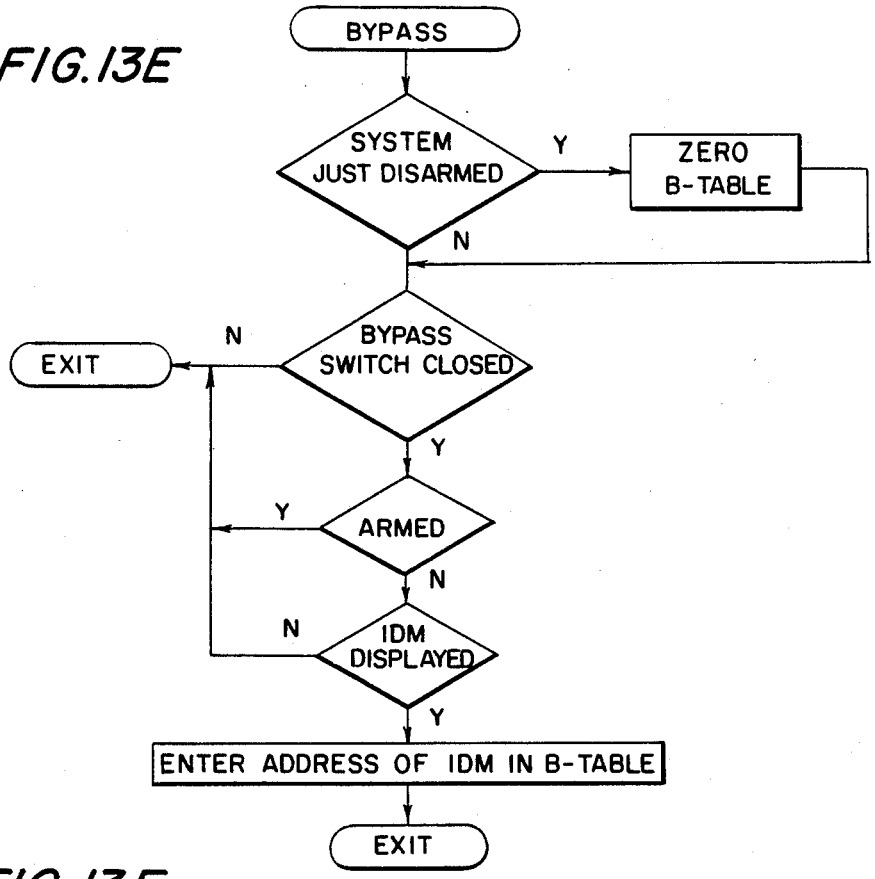
FIG. 13F
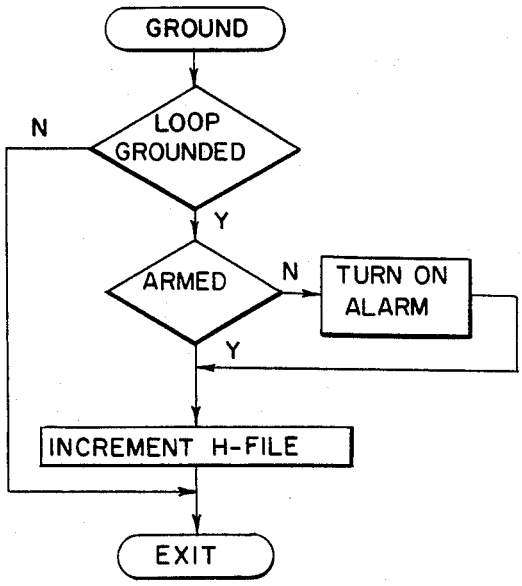
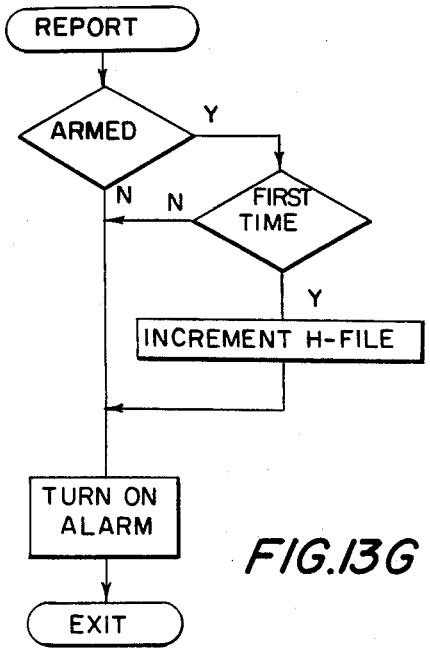
FIG. 13G

SINGLE-WIRE LOOP ALARM SYSTEM

DESCRIPTION

This invention relates to single-wire loop alarm systems, and more particularly to identification modules for use therein which allow a central panel to determine which switches in the loop are open.

The alarm system which enjoys the most widespread use is that which utilizes a single-wire loop. A switch is used for each window, door, etc.; all of the switches are normally closed, and they are all connected in series in the loop. A current normally flows through the loop, and upon opening of any switch the current ceases. It is the cessation of current which triggers an alarm.

Where there are many switches connected in a loop, it is advantageous to be able to identify the location of the trouble—not only "trouble" with an intruder, but even trouble with a switch. If a switch breaks and opens, the entire system cannot be armed unless the switch is somehow by-passed. The first thing that has to be done, of course, is to identify the malfunctioning switch.

Especially in large installations, a multi-zone approach is often taken. A number of independent single-wire loops are run from a central alarm panel. Each loop has a number of serially connected switches, obviously less than the total number of switches in the system. Once it is determined in which loop current has stopped flowing, the search for the open switch is restricted to just those switches in that loop. Furthermore, it is possible to arm the overall system, even if the identity of the open switch cannot be determined, simply by by-passing the loop whose current has stopped. Carried to the extreme, a multi-zone system would include an individual loop for each switch. Needless to say, while this offers ultimate control and ease of servicing, the cost can be prohibitive.

It is an object of our invention to provide such low-cost, reliable multi-zone functions in a single-wire loop alarm system.

It is another object of our invention to provide such functions in a way which is fully compatible with the vast majority of existing alarm installations, thereby enabling these installations to be up-graded and retrofitted at minimum expense.

It is still another object of our invention to provide an identification module for an alarm switch which is so small and low in cost that it can actually be made a part of the switch itself, the switch looking no differently from the conventional switches now in use.

Several approaches to achieve similar ends have been taken in the prior art, although none has proven to be both economical and reliable. Many of the prior art systems are based on analog techniques. For example, in U.S. Pat. No. 3,760,359 a resistor is placed across each alarm switch, with resistance values uniquely identifying respective switches. In order to be able to identify more than one switch being open at the same time, the magnitudes of the resistors should assume a binary sequence (1K, 2K, 4K, 8K . . .). No impedance has an effect on the loop current until its respective switch opens, at which time it is inserted in the loop. Each combination of open switches has a unique total impedance associated with it and, by measuring the impedance of the loop, all of the open switches can be identified. The problem with such a system is that due to the practical limits of resolution, not very many switches can be accommodated in a given loop.

A similar system is shown in U.S. Pat. No. 4,240,078. Here, a module is placed across each switch, each module being an oscillator set to a unique frequency. When the respective switch opens, the loop current follows the oscillator frequency, thus allowing the open switch to be identified at the central panel. The major problem with this method is that highly accurate and stable oscillators must be employed if there are to be many switches in the loop. Furthermore, if two or more switches are open simultaneously, there may be undesirable interaction of the signals from the various modules, and there may also be insufficient voltage across the loop to power all of the operative modules since they are all connected in series.

A related method is disclosed in U.S. Pat. No. 4,257,037; in this method, passive tuned circuits are placed across the switches. An AC signal may be applied to the loop its frequency being swept. Any open switch will cause its associated tuned circuit to resonate at its assigned frequency, this being reflected at the central panel. In addition to the requirement for careful tuning of each module and the use of reasonably accurate and stable components, the number of modules which can be included in a single loop is limited due to the limited bandwidth of a typical single-wire loop and the need to space the resonant frequencies far enough apart so that the modules do not interfere with each other. Alternatively to having the modules "turn on" when a respective frequency appears on the line, it is possible to use a swept voltage with each module responding to a unique threshold value. (See, for example, U.S. Pat. No. 4,041,455.)

As a rule, the analog systems of the prior art have one thing in common. Each identification module is placed in parallel across a respective switch. As long as the switch is closed, the module is by-passed. Each module is effectively connected in the loop only when its respective switch opens. At this time, the loop is modified (either directly such as by having the module place a unique impedance value in the loop, or indirectly such as by the module responding to a sweep frequency), and the effect on the loop can be sensed at the central panel. None of these analog systems has proven to be reliable. None of them combines economy with the ability to identify numerous switches at the same time. At one extreme there are simple binary-weighted resistances, but problems in resolution do not even allow ten modules to be included in the same loop. At the other extreme there are costly, e.g., carefully tuned, modules but they are so uneconomical that they have enjoyed no commercial success.

That digital techniques can be used to identify one or more open switches is beyond question. There are probably thousands of applications in which a central processor queries or polls uniquely addressed peripheral devices or even other processors. On the smallest scale the technique is used on every microprocessor bus; every peripheral device has a unique address and that device can either interrupt the processor, or respond to a query addressed to it, or both. On perhaps the largest scale, there are interactive cable TV systems each of whose subscribers is given a unique address, with the head end of the system polling each subscriber by transmitting a unique address. Digital methods work, and they will certainly work in an alarm system. The important thing, however, is to be able to use an identification module which is not only cheap to manufacture and which can be programmed to respond to a unique address with minimum effort by unskilled personnel, but which can also be used in the vast majority of installed alarm systems—single-wire loops.

An example of a prior art digital alarm system is that shown in U.S. Pat. No. 3,613,092. The technique disclosed in this patent is typical of those which are finding widespread use in electronic systems (although not necessarily alarm systems); what is involved is a multi-wire bus which cannot be adapted to a single-wire loop. The patent does teach a technique, however, which is utilized in the preferred embodiment of our invention—the transmission of an address to a device to be polled by transmitting a number of pulses equal to the device's address. Similar pulse-count techniques are disclosed in U.S. Pat. Nos. 3,585,596; 4,088,983; and 4,435,706, and in general it can be said that it is known to use a pulse count as a data format.

There are also numerous prior art digital systems which utilize a two-wire bus. All of the devices which must be polled, or which otherwise must inform the central control of required action, are connected in parallel across the two-wire bus. An example of such a scheme is shown in U.S. Pat. No. 4,093,946. A two-wire bus of this type generally requires more wire to be used at any given installation than a single-wire loop, but this in and of itself is not a major drawback. Nevertheless, such a two-wire bus has not gained acceptance because it represents a departure from the serial wiring method which is the industry standard.

Another problem with many digital systems is that the modules have to be self-powered. It is apparent that it is not feasible in a typical burglar alarm system to provide a power source for each switch.

Other digital systems which were uncovered during the course of a search are U.S. Pat. Nos. 4,468,664 and 4,494,115, but they are not believed to be particularly pertinent to our invention.

All of the requirements of an "ideal" alarm system are met by the system of our invention. An identification module is placed in parallel across each conventional switch in a series loop. In order to retrofit an existing system, all that is required, in addition to placing an identification module across any switch which must be identified when open, is to place a central control in the existing system between the installed alarm panel and the two ends of the single-wire loop. The identification modules are not self-powered. As long as an alarm switch is closed, no current flows through the associated identification module since it is shorted by the normally-closed switch. However, when the switch opens, current is no longer by-passed and it flows through the module; the loop current now powers the module.

When an alarm switch opens and the associated identification module is powered, a voltage drop, 5 volts in one embodiment of the invention, appear across the input of the module. It is the powering of the identification module which is reflected as a changed loop characteristic. The central control causes a constant current to flow through the loop, derived from a 35-volt supply. Because there is now a drop of 5 volts across the open switch, there is a drop in the potential across the two ends of the loop at the control panel. It is this changed potential which informs the central control that a switch is open. Because a 35-volt supply is used, and there is a 5-volt drop across each switch when it is open, the system is capable of identifying up to 6 open switches in each polling cycle in this illustrative embodiment of the invention.

The central control, which includes what we call a tracer panel, initiates a polling cycle by pulsing the loop. The loop current is caused to momentarily cease for 1 millisecond, at 2-millisecond intervals. The total number of current cessations in this manner represents the address of the module being interrogated. Only when the total count in any interrogation cycle equals the address of a module does it take action, provided that its associated switch is open and it is powered in the first place. The module changes the loop characteristic at this time, and in the illustrative embodiment of the invention causes the voltage drop across the switch to be reduced from 5 volts to 3 volts. The momentary change which is sensed at the tracer panel is an indication that the alarm switch now being addressed is open.

At the end of the polling cycle the loop current is interrupted for 10 millseconds. This is a reset signal which in effect causes each identification module to power down. When the loop current resumes and current is applied to all identification modules associated with open switches, they go through a power up sequence in preparation for another polling cycle.

It should be appreciated that an identification module is only required for the identification of the location of an open switch. If the module itself operates improperly, that does not affect the operation of the alarm system itself. Also, if any switches are not provided with identification modules, that simply means that those switches cannot be identified when they are open; the alarm system itself, however, remains operative.

The identification modules are completely digital in operation. No tuning or adjustments are required during installation or service. Custom IC fabrication permits not only small size and low cost, but the modules can actually fit inside standard magnetic switches if desired.

As will be described, all of the identification modules are supplied by the manufacturer in identical form—without associated addresses. There are fusible links in each module which can be programmed to assign a unique address to the module. We provide a special "gun" for this purpose. In another embodiment of the invention, once all of the modules are in place in a system it is actually possible to program them semi-automatically from the central control, that is, a special sequence of currents applied to the loop can control the assignments of different addresses to each identification module.

In one embodiment of the invention, each identification module is provided with a rectifier bridge at its inputs. This permits the module to be placed across an alarm switch without paying attention to the polarity of the connection. The slightly increased cost of the module reduces the possibility of error on the part of an installer. In a second embodiment of the invention, the rectifier bridge can be omitted with the module still being insensitive to polarity, although a more complicated polling sequence is required, as will be described. The significant advantage of the second embodiment is that it permits the identification of many more simultaneously open switches.

Further objects, features and advantages of our invention will become apparent upon consideration of the following detailed description in conjunction with the drawing, in which.

Figures 1, 2, 3:
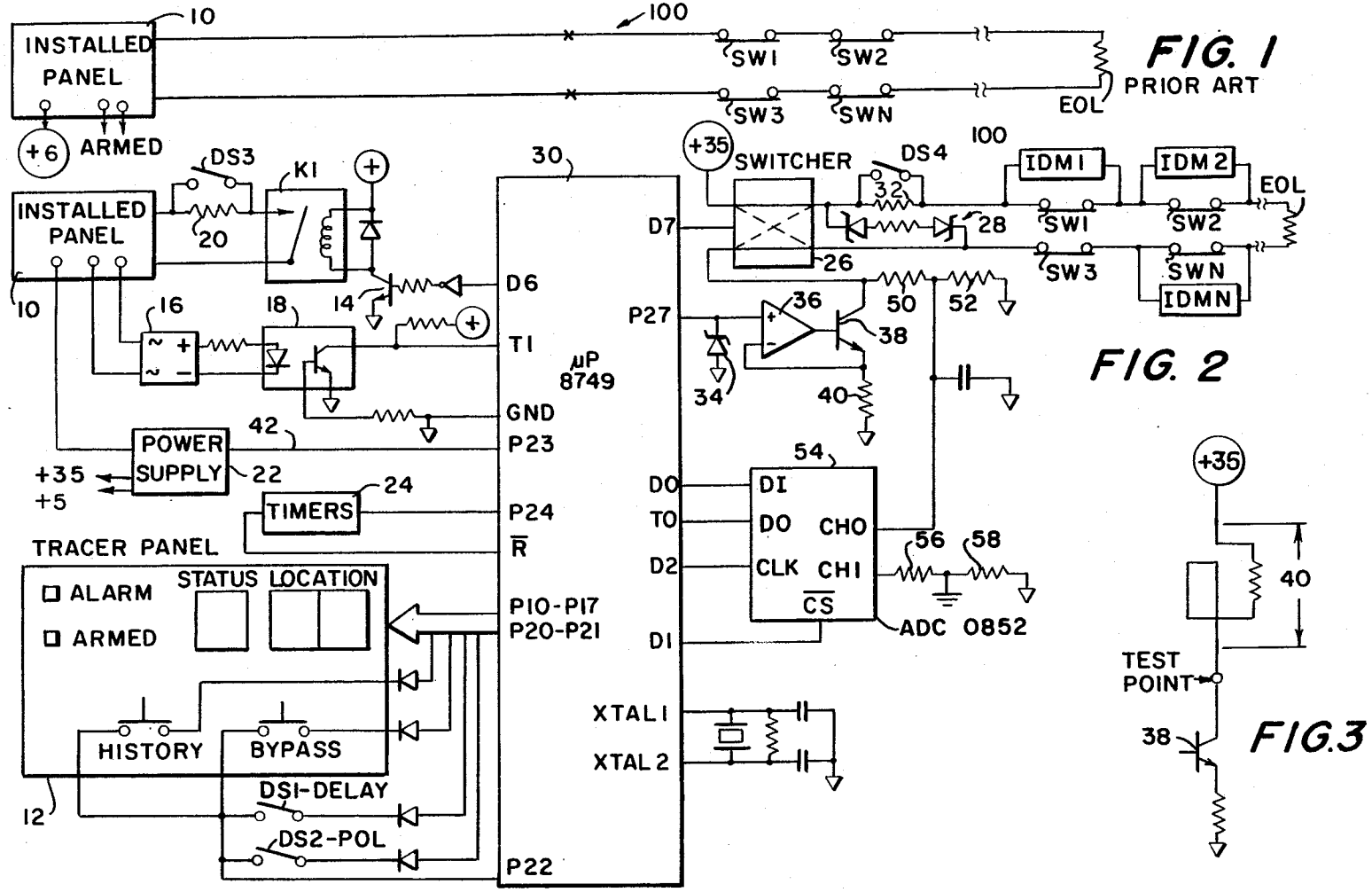
FIG. 1 PRIOR ART
FIG. 1 depicts a typical prior art single-wire loop alarm system.
FIG. 2 depicts the manner in which the prior art system can be retro-fitted in accordance with the principles of our invention, by the addition of a central control near the installed alarm panel, and the placing of an identification module across each alarm switch which must be identified when open.
Figures 4, 5:
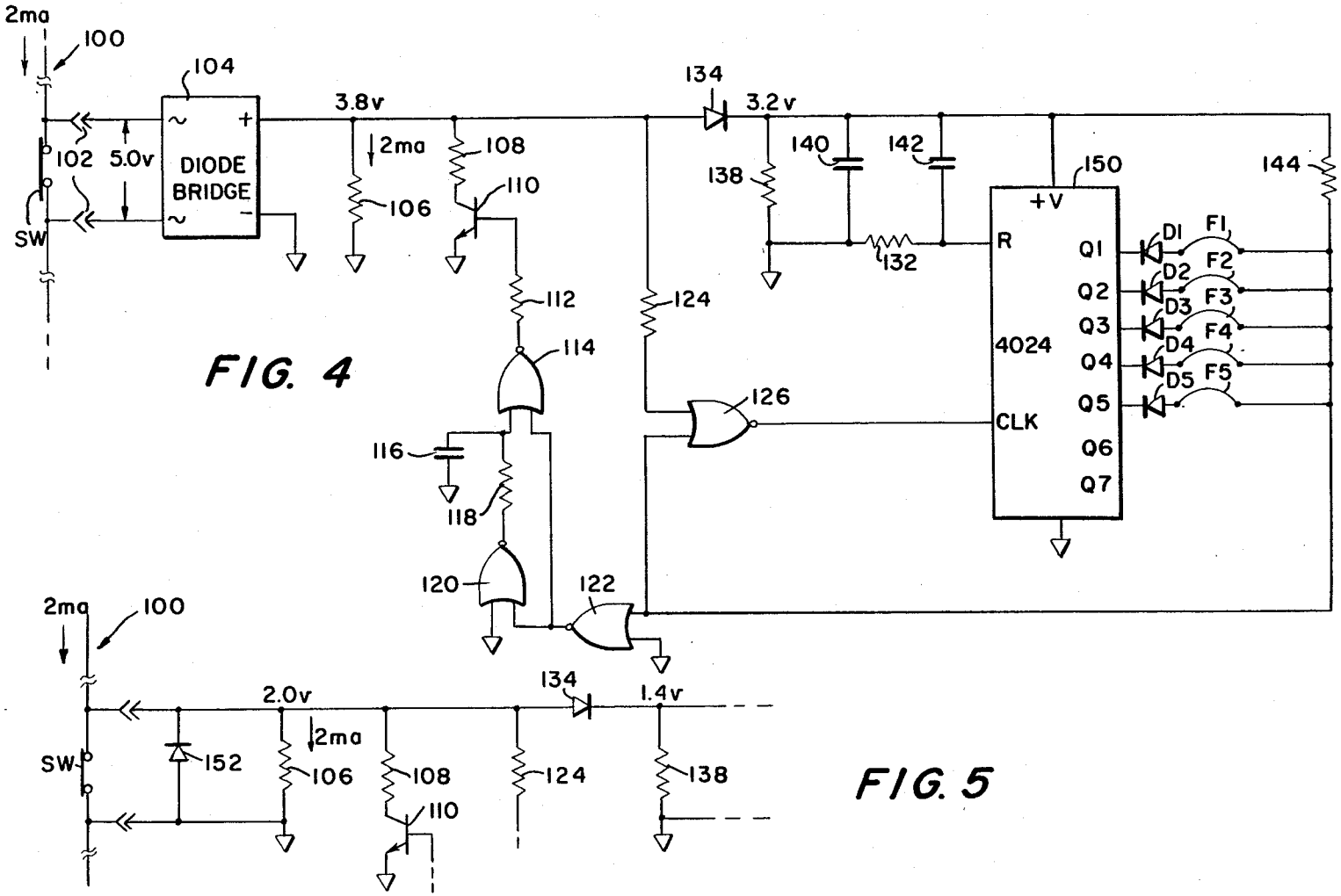
Figure 6A:
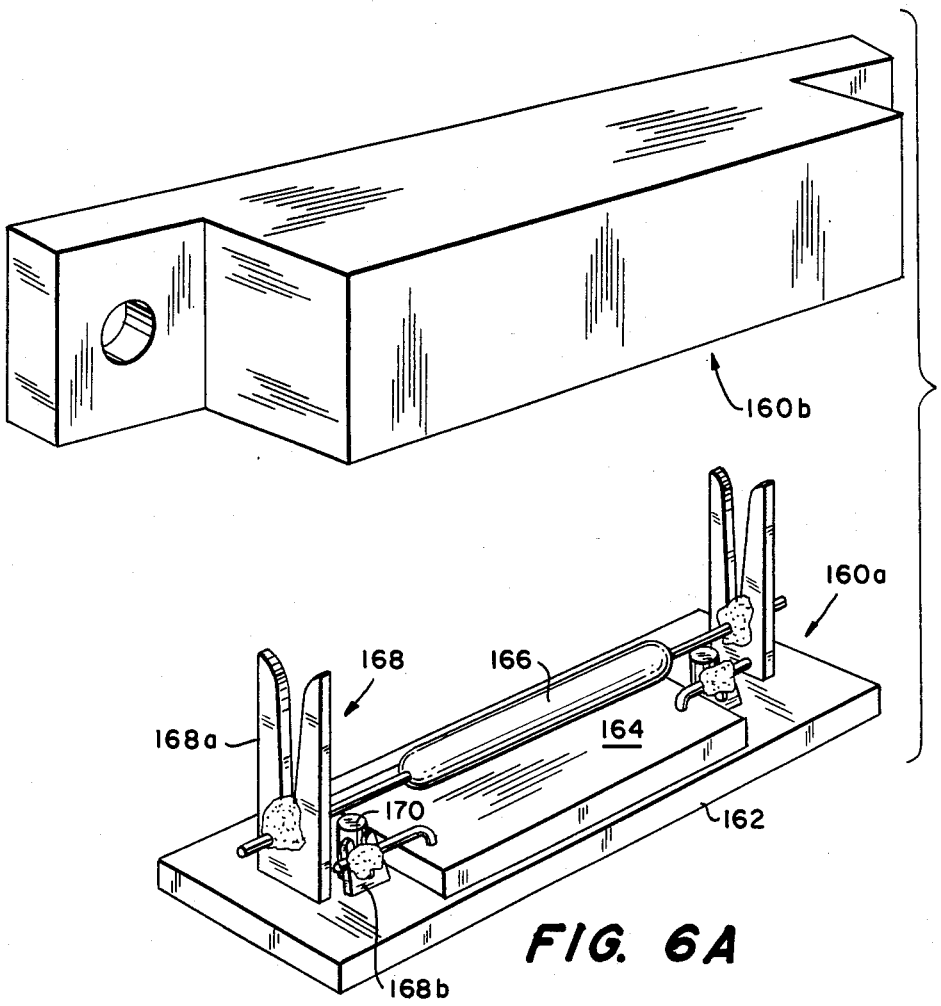
Figure 6B:
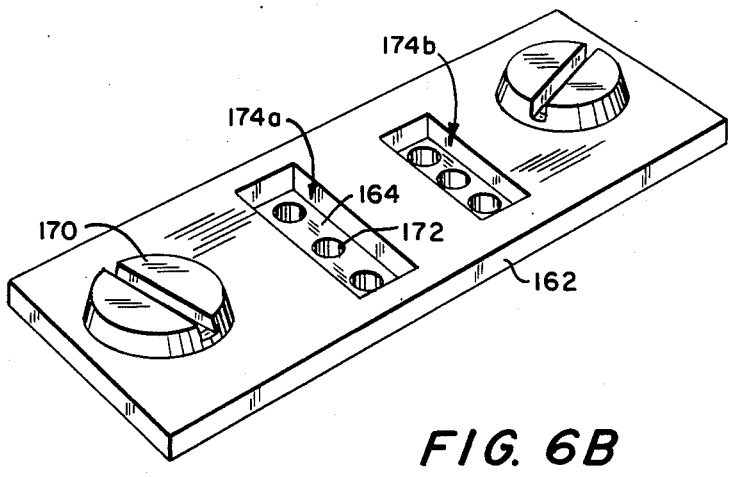
Figure 7A:
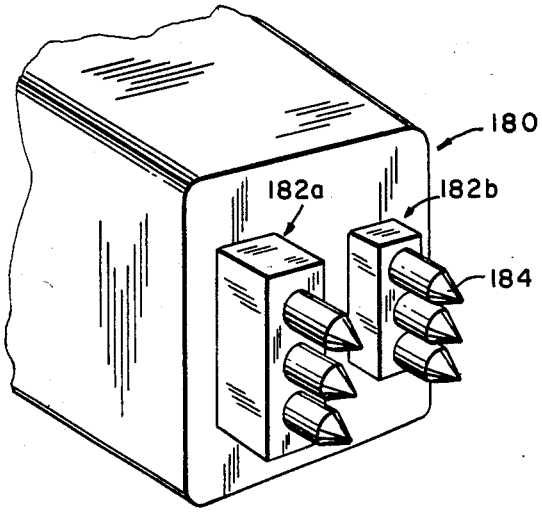
Figure 7B:
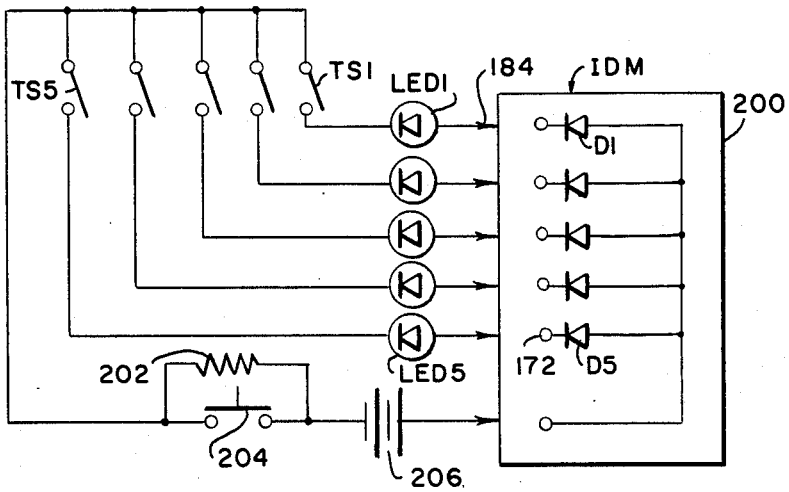
Figure 8A:
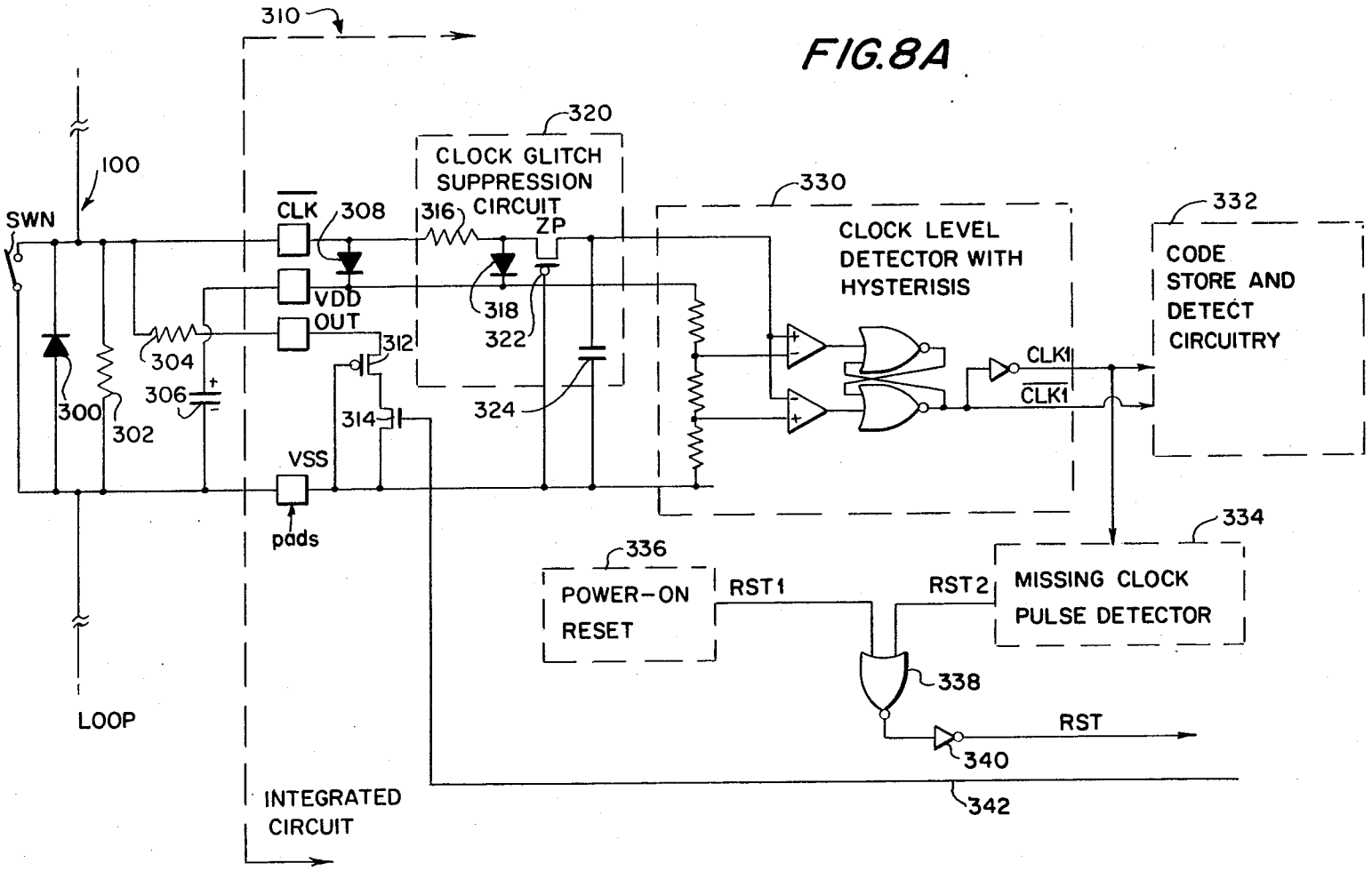
Figures 8B, 8C, 8E:
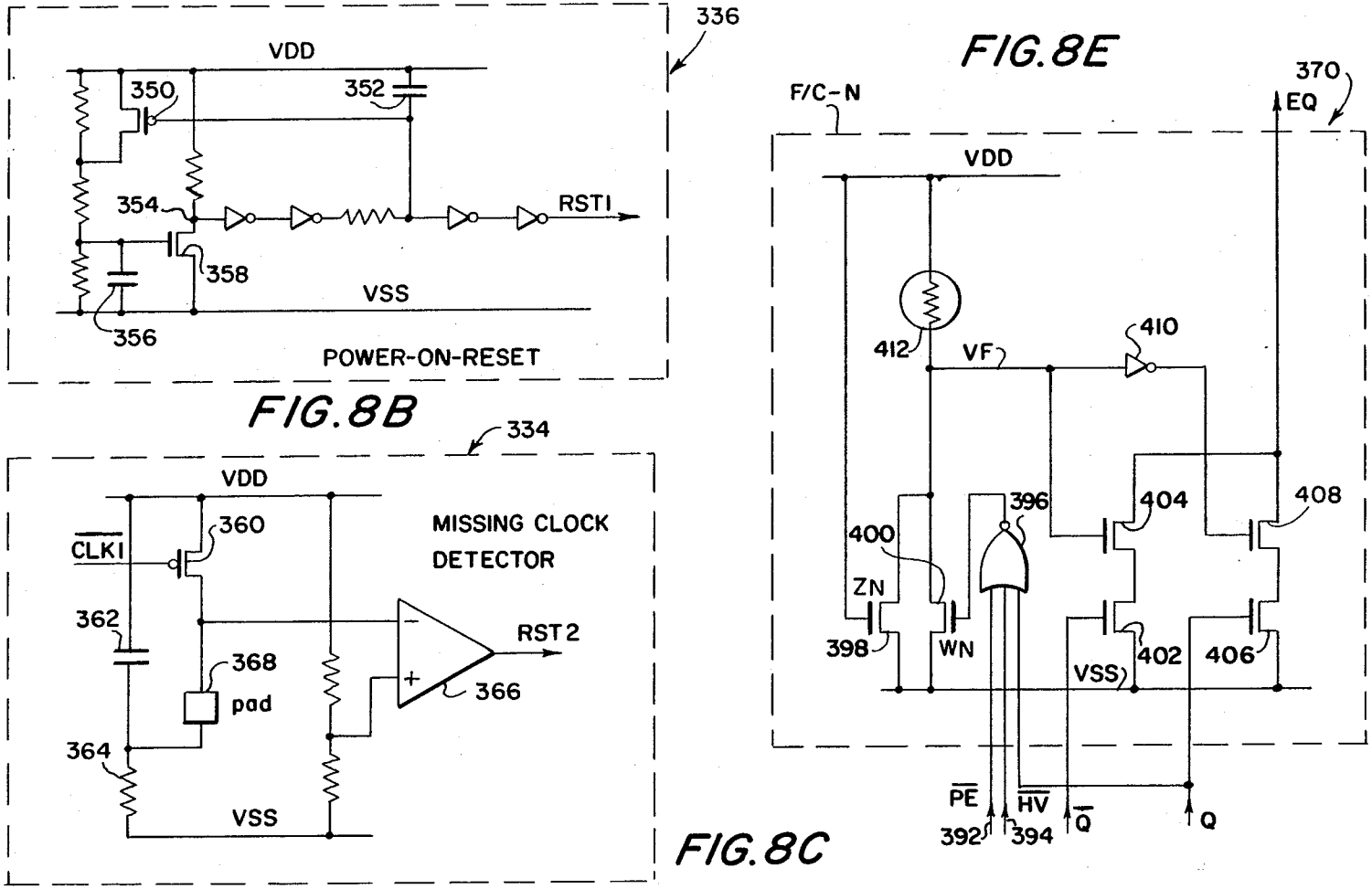
Figure 8D:
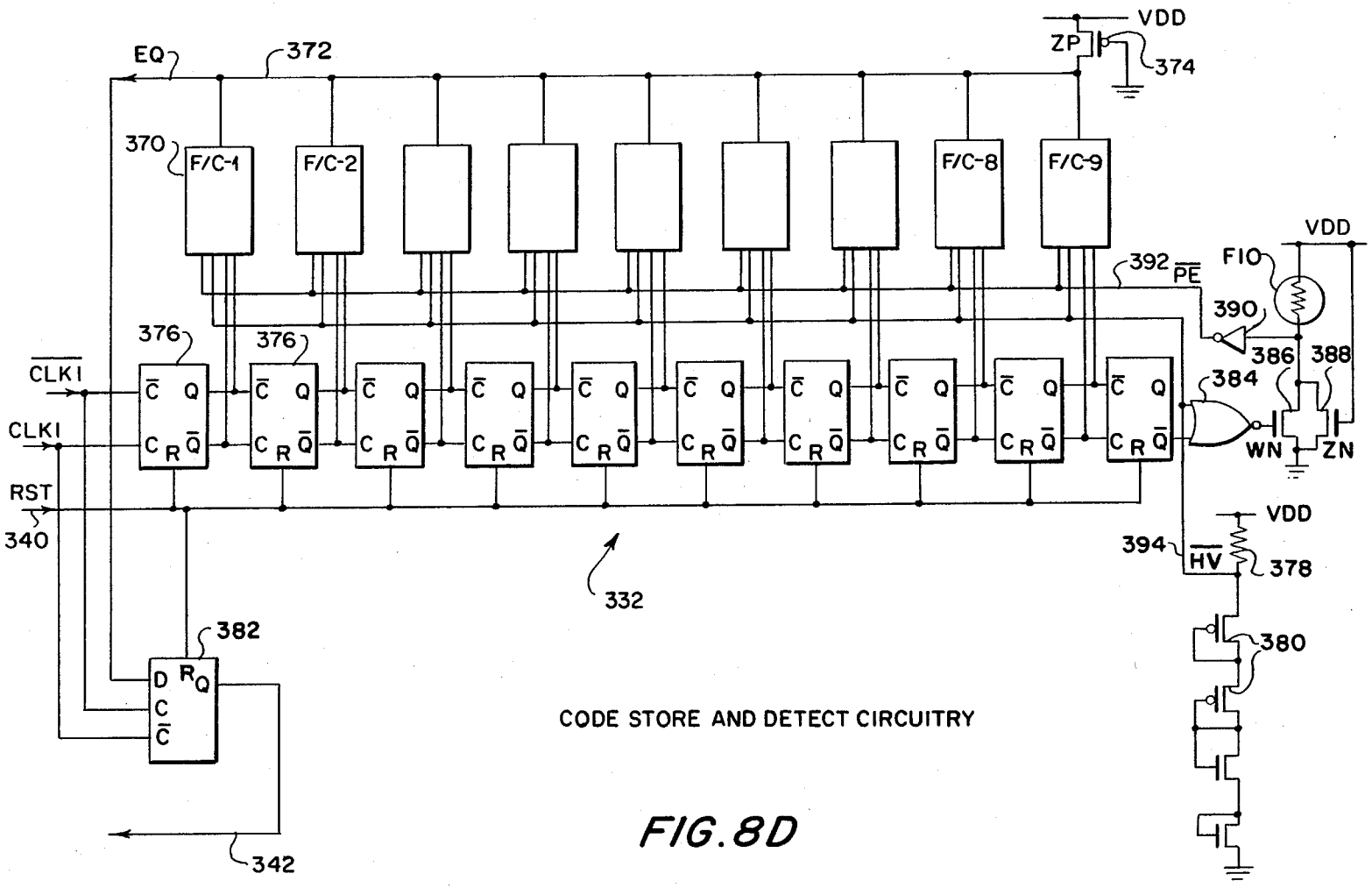
Figure 9:
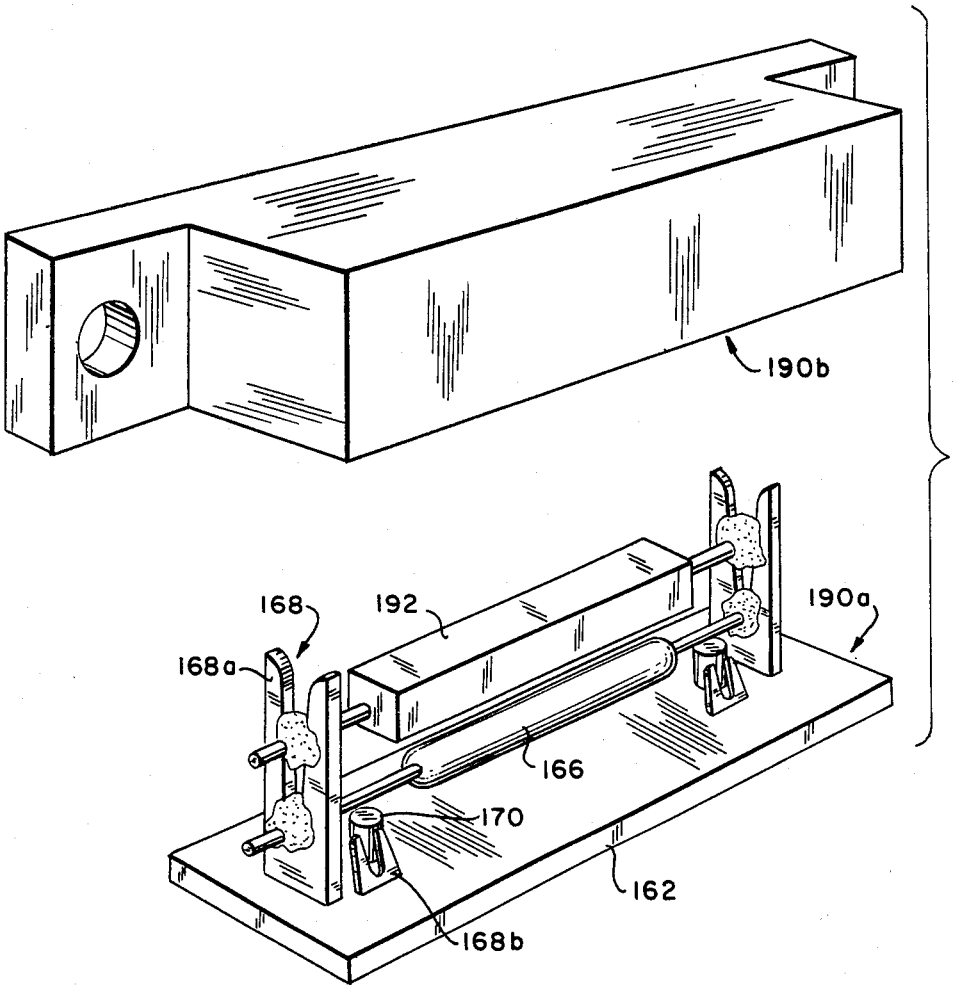
Figure 10A:
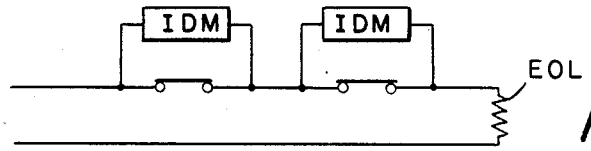
Figure 10B:
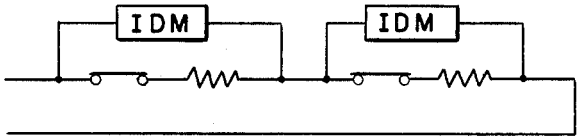
Figure 10C:
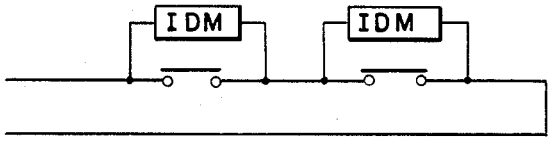
Figure 11:
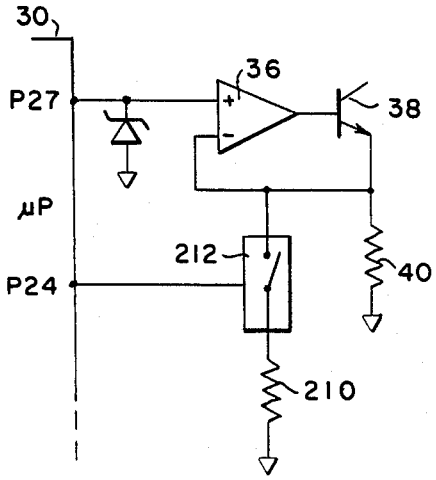
Figure 12:
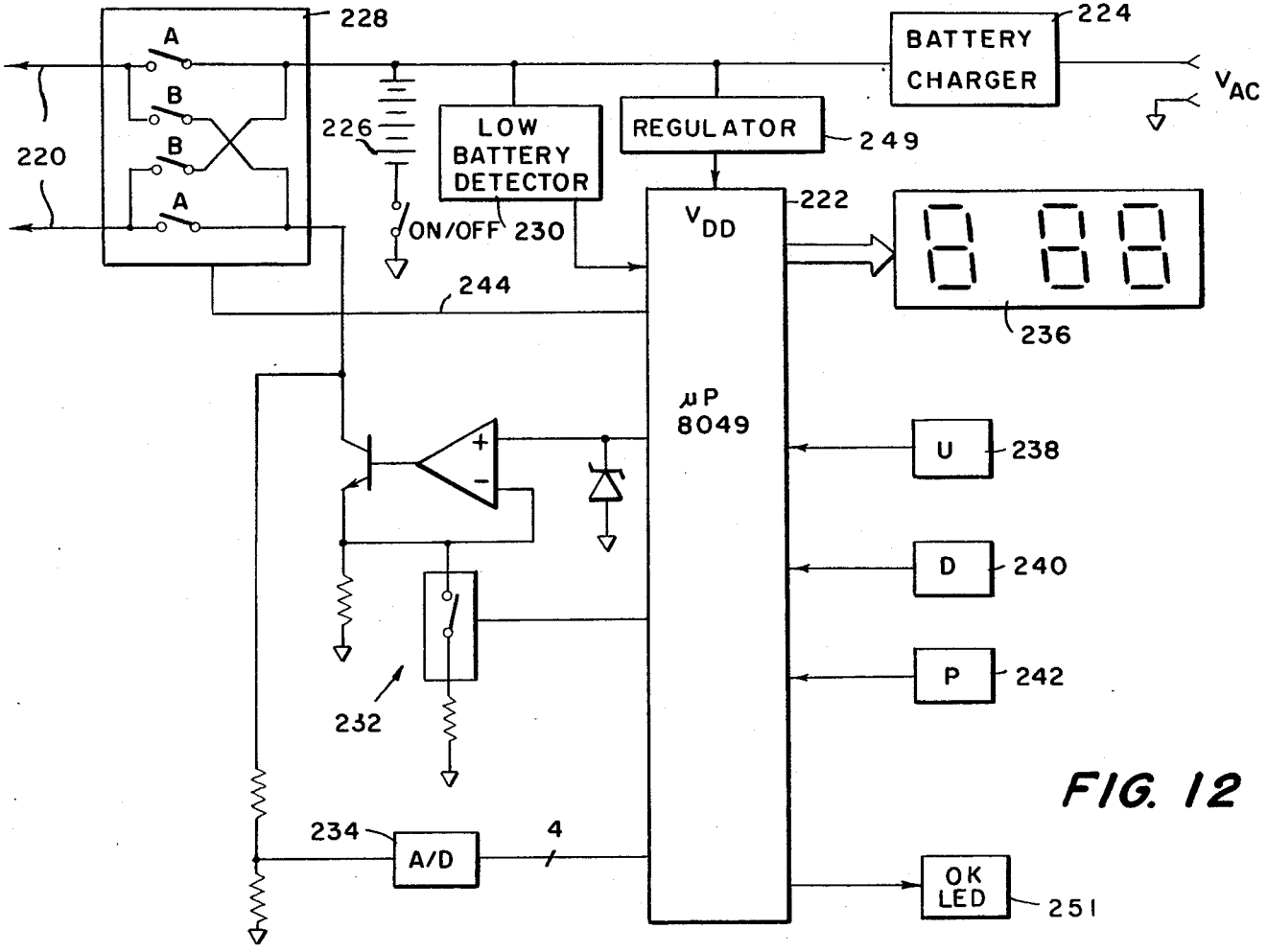
Figure 13A:
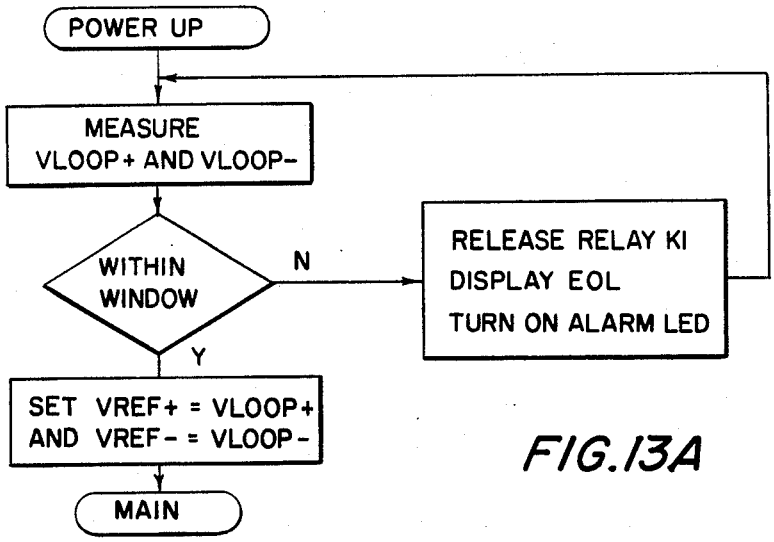
Figure 13B:
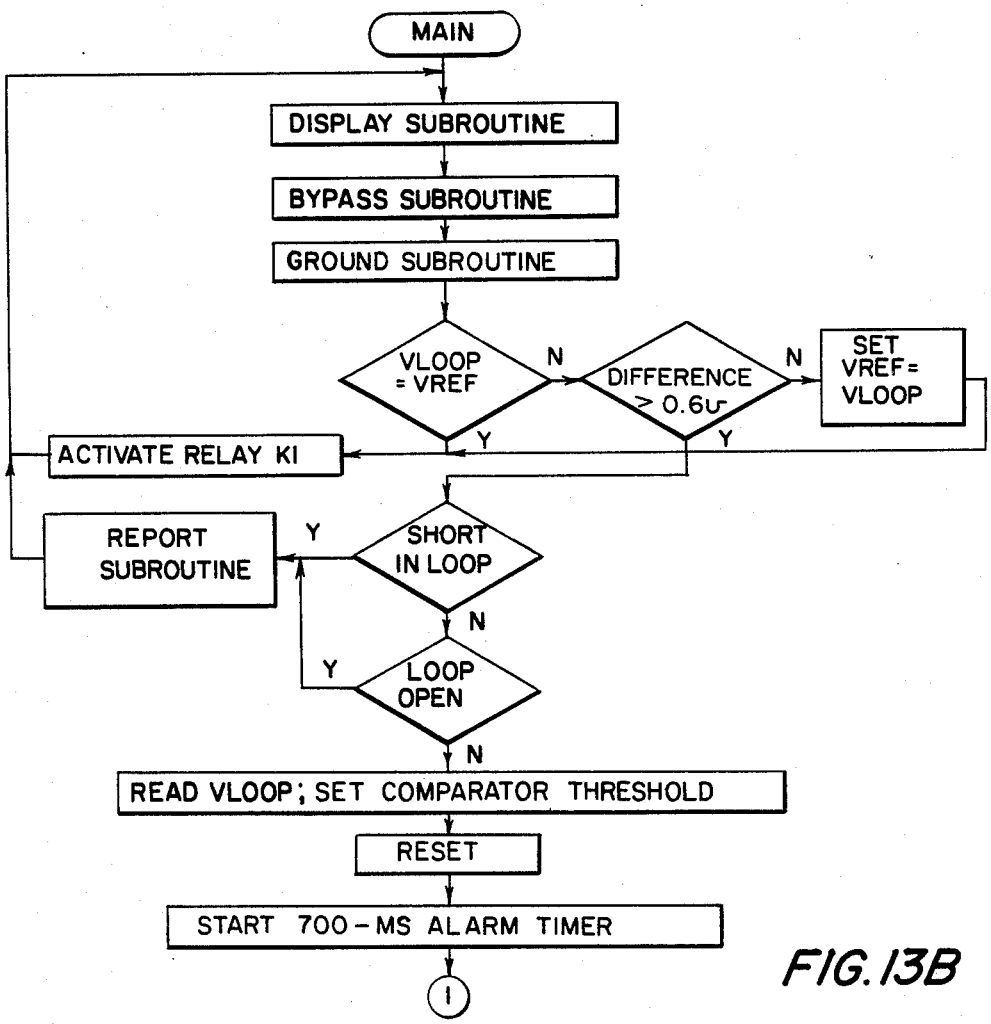
Figure 13C:
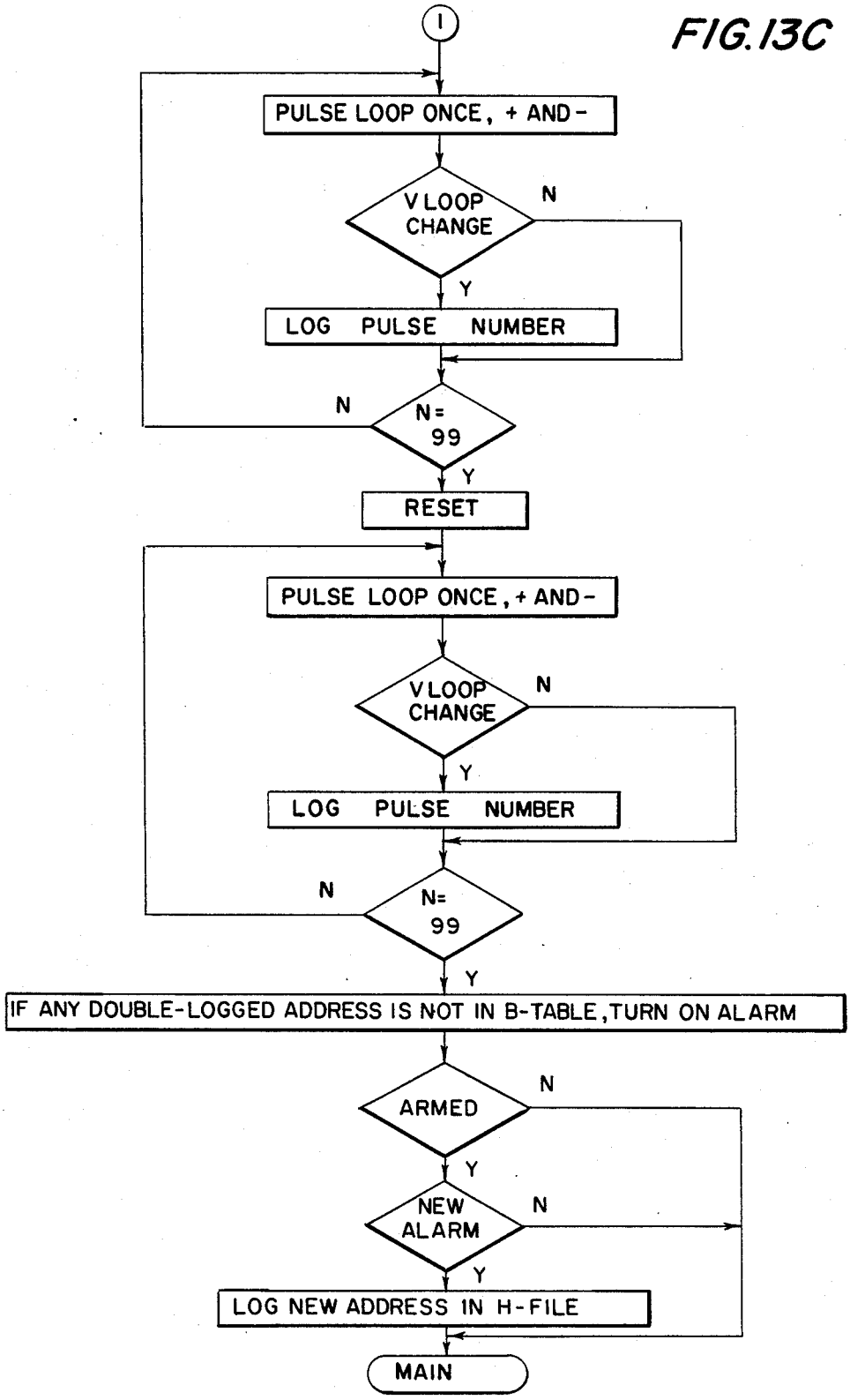
Figure 13D:
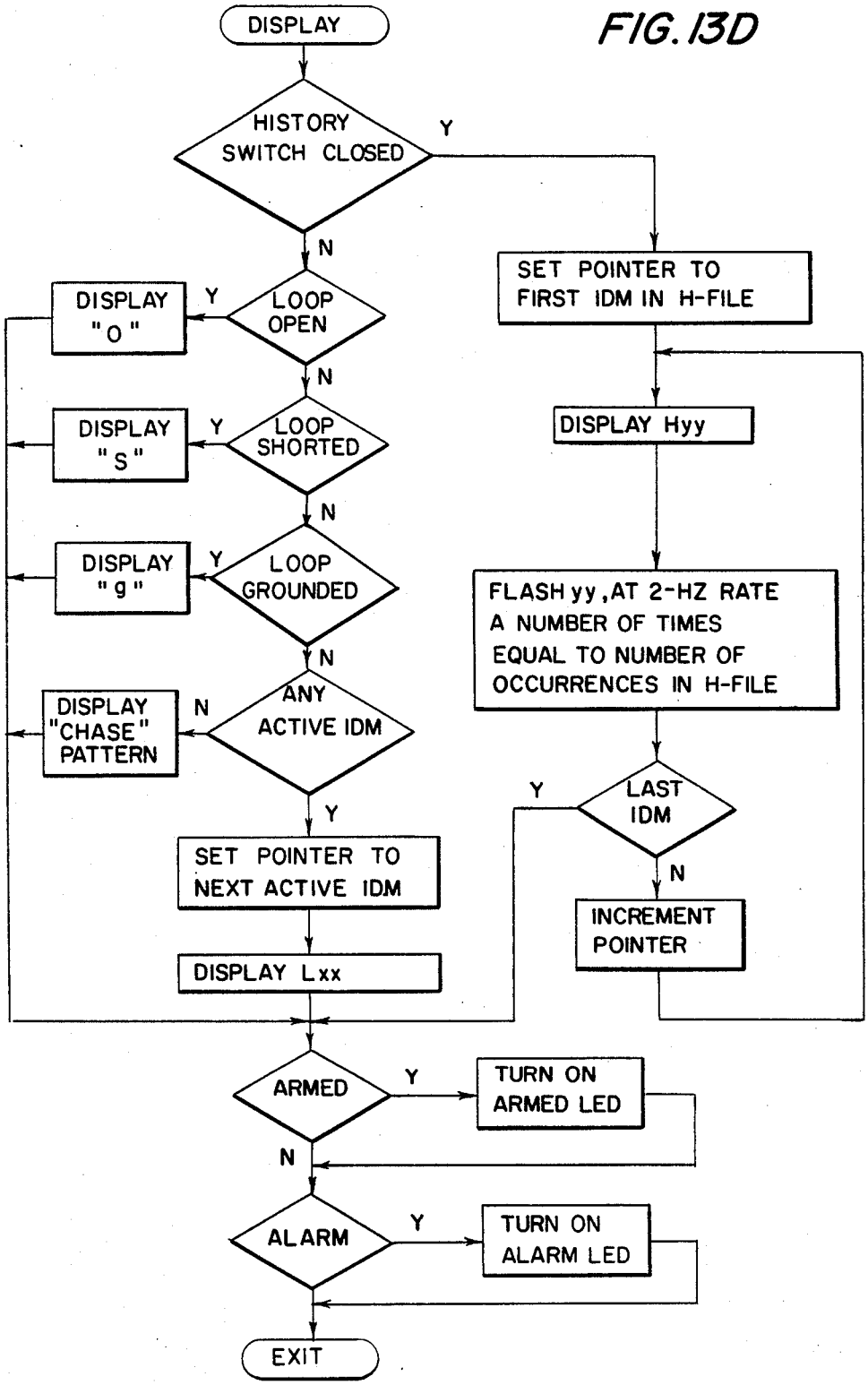
Figure 14A:
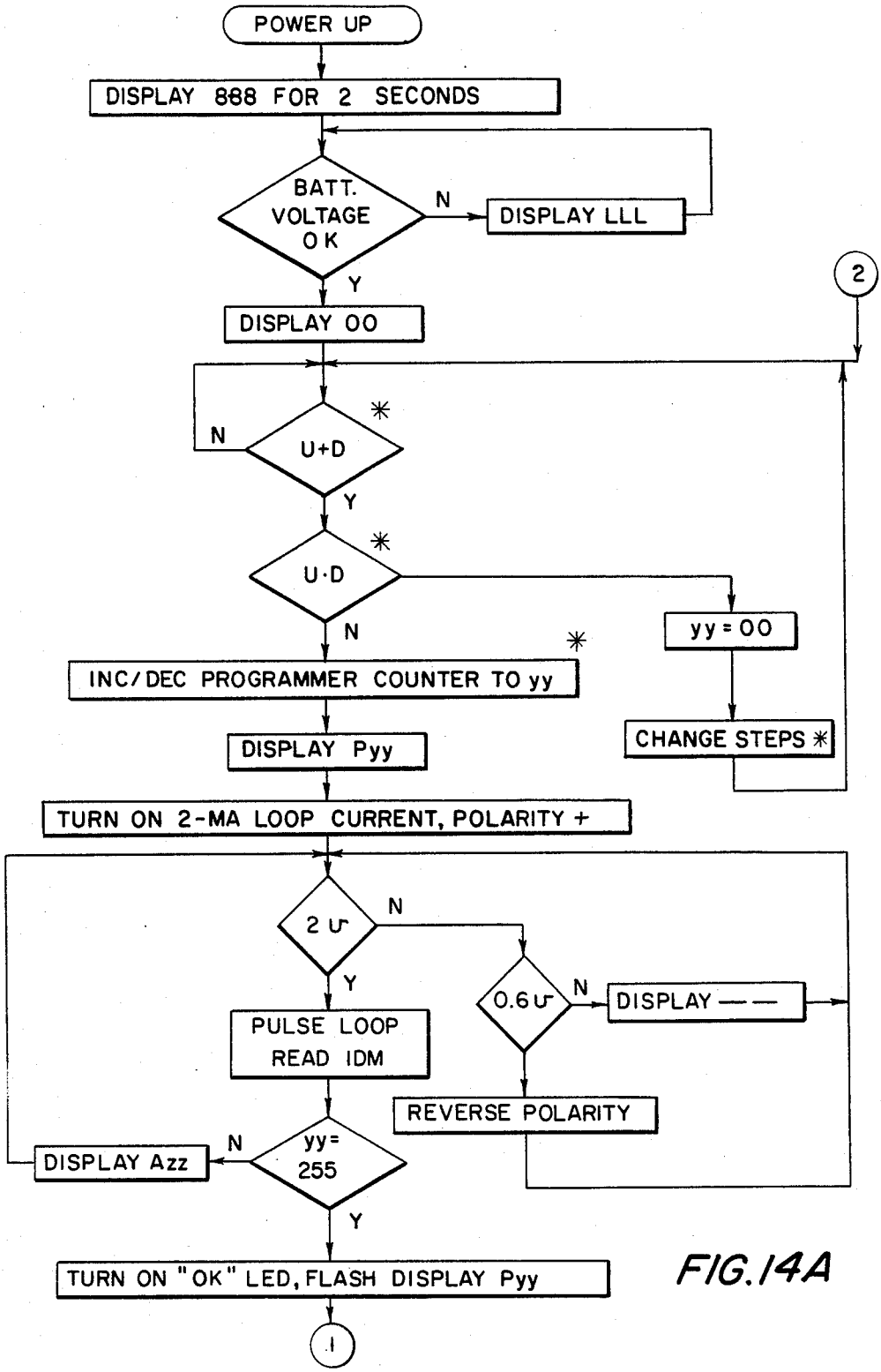
Figure 14B:
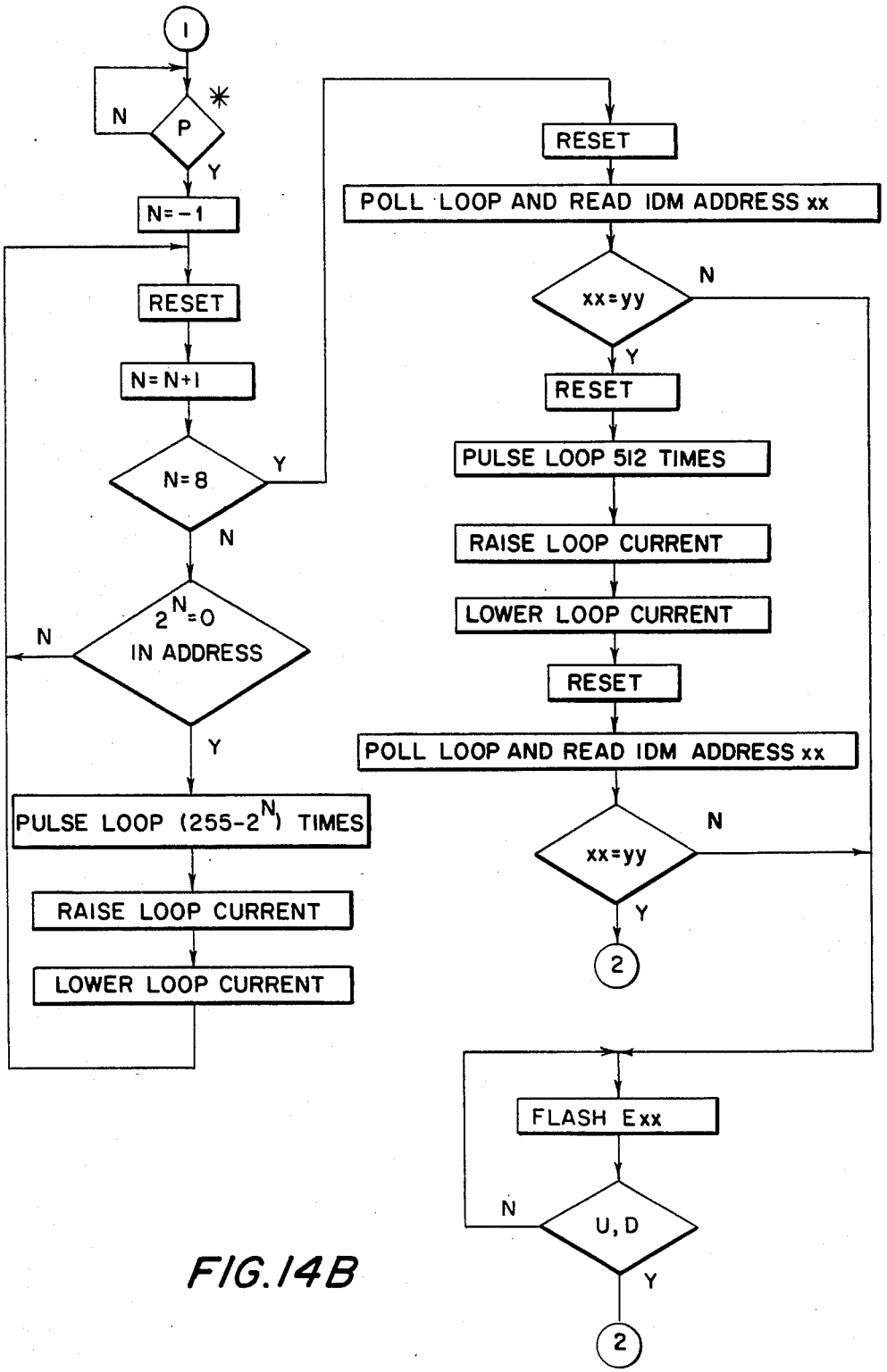

FIG. 3 will be helpful in understanding the manner in which voltage increases and decreases at the test point of the system of FIG. 2 represent different conditions of interest;

FIG. 4 depicts a first illustrative identification module of our invention, one which can be built with discrete components;

FIG. 5 depicts a second illustrative identification module of our invention, with elements comparable to elements of FIG. 4 not being shown, the module of FIG. 5 being intended for custom design so as to permit not only lower operating potentials, but also the identification of many more modules on the loop;

FIGS. 6A and 6B depict the manner in which an identification module constructed along the lines of FIG. 4 may be housed inside a conventional type alarm switch;

FIGS. 7A and 7B. depict a programming gun which may be used to program an address in a module of the type shown in FIGS. 6A and 6B, and to read the address of a module whose address is unknown;

FIGS. 8A–8E depict an identification module whose address can actually be programmed while the module is in the loop, by applying the requisite current sequence on the line, this module thus being a two-terminal device which does not require installer access to any additional pins for address programming purposes;

FIG. 9 depicts the manner in which the identification module of FIG. 8 may be housed in a conventional type alarm switch;

FIGS. 10A–10C depict three modes in which the identification modules of our invention may be used in a single-wire loop;

FIG. 11 depicts additional circuitry required for the central control unit of FIG. 2 to operate in the system mode represented by FIG. 10B;

FIG. 12 depicts a system (portable, to be used by an installer) to effect the programming of addresses of the identification modules in accordance with a current sequence which is applied to the loop;

FIGS. 13A–13G are flow charts which depict the more significant steps in the sequencing of the microprocessor in the central control unit in the embodiment of our invention symbolically represented in FIG. 10A, when used with modules of the type shown in FIG. 5; and FIGS. 14A–14B are additional flow charts which depict the more significant steps in the sequencing required for semi-automatic address programming of the modules when using the system of FIG. 12.

GENERAL SYSTEM DESCRIPTION

One of the most important advantages of our invention is that it works with the vast majority of installed alarm systems. These systems have a single-wire loop 100, as shown in FIG. 1, in which a plurality of switches SW1–SWN are placed in series. Each switch is normally closed. A low-magnitude continuous current flows through the loop as long as all of the switches are closed. The two ends of the loop are connected to an installed alarm panel 10. The panel sounds an alarm when the loop current is broken. Typically, the panel is powered by a 6-volt supply and a terminal at this supply voltage level is shown in FIG. 1 because advantage is taken of it in the embodiment of the invention shown in FIG. 2. The conventional prior art system of FIG. 1 includes an end-of-line resistor EOL. The purpose of this resistor is to allow a shunt in the loop to be detected. If there is a shunt which diverts the current from resistor EOL, the current increases and the increase, when sensed, informs the alarm panel that there is a problem.

The prior art system of FIG. 1 is shown with two terminals, labelled "armed," as part of the installed panel 10. Somewhere in the typical installed panel there is a pair of terminals the potential across which indicates whether the system is armed or disarmed. The potential differs from system to system; it can be AC, or DC, and its magnitude may vary. Moreover, the "polarity" of the signal varies from system to system; in some, a high signal represents an armed condition, and in others it represents a disarmed condition. Certain features of the control unit of our invention rely on arming and disarming commands being given by the user via the installed panel, and the potential appearing across the "armed" terminals in the installed panel is used, as will be described in connection with FIG. 2, to indicate to the control unit of our invention whether the user wants the system to be armed or disarmed. (A DIP switch in the control unit of our invention is set in one position or the other to indicate to the microprocessor the "polarity" of the "armed" potential.)

The prior art system of FIG. 1 is also shown with two points X—X in the single-wire loop. These points are intended to depict where cuts are made in the installed system to accommodate the control unit of our invention.

One of the main objects of our invention is to provide a mechanism whereby an open switch can be identified readily even though it is one of many on the same serial single-wire loop. It is not that the serial loop configuration is the best possible. What is important is that most burglar alarm systems are of the single-wire loop type, and what is needed is a simple, fail-safe way to provide an "add-on" or direct replacement device for determining which of many switches in the same loop are open. In the illustrative embodiment of the invention depicted in FIG. 2, when used with identification modules of the type shown in FIG. 4, up to six simultaneously open switches may be identified, typically in a grouping of perhaps up to 128 in the same loop.

The illustrative embodiment of the invention has been shown the way it is in FIG. 2 in order to get across the idea that the invention can be used in an "add-on" capacity. The same prior art loop of FIG. 1 is shown, together with the installed alarm panel 10. The control unit of the invention is simply inserted in the loop by cutting the single-wire loop in two places, as described above in connection with FIG. 1, and making appropriate connections. As will be described, the control unit requires a 35-volt supply. In order to be able to use the 6-volt supply of the installed alarm panel if that is desired, a power supply 22 is provided for stepping up the voltage. Power supply 22 is a DC-to-DC converter and may be of conventional design. However, instead of making it free-running, microprocessor 30 pulses conductor 42 at fixed intervals. The reason for this is that the microprocessor, as will be described, is responsible for voltage measurements across the loop and, by synchronizing the measurements and converter operations to occur in different portions of an overall cycle, the measurements are not affected by transients produced by the power supply. The power supply also derives a regulated 5 volts for powering the microprocessor and its associated logic circuitry.

Individual identification modules are placed across respective switches. Three such modules, IDM1, IDM2 and IDMN are shown in FIG. 2. (If any switch, such as SW3, is not shunted by an identification module, it can still trigger an alarm when opened. However, the control unit will be unable to ascertain which switch is open.) Each of the modules is assigned a respective address by programming it appropriately. The control unit interrogates all of the modules serially, and any module which is associated with an open switch responds in such a manner that the control unit is informed that the switch is open. The control unit is capable of identifying up to six open switches in each polling cycle in the illustrative embodiment of the invention.

When any switch is open, the connected identification module drops 5 volts across the switch. If it is desired to sense up to 6 open switches, there will be a total drop across the 6 switches of 30 volts. It is for this reason that a 35-volt supply is used; a sufficient voltage must be applied across the loop to allow a number of voltage drops to be sensed. A lower supply voltage for the loop would still allow the system to function, but fewer simultaneously open switches could be ascertained.

The loop, broken at points X—X of FIG. 1, is connected to the control unit of FIG. 2 as shown. One end of the loop is connected directly to switcher 26 (a solid-state double-pole, double-throw relay), and the other is connected through a resistor 32 which is bypassed or not bypassed depending upon the position of DIP switch DS4. The control unit may expect an end of line resistor in the wire loop. If one is not present, DIP switch DS4 is opened by the installer; the resistor is needed so that with the predetermined quiescent current of 2 milliamperes, a potential drop of about 4 volts will appear across the loop. The exact value of the potential drop is not important if the system self-calibrates.

The other ends of the cut wires in the loop are also connected to the control unit; the installed panel is shown connected as shown in the upper left part of FIG. 2. The 6-volt potential of the installed panel is extended directly to power supply 22 and, as described above, controls the generation of a 35-volt potential under control of the microprocessor. The "armed" potential is extended to the AC inputs of bridge 16, and the DC output is extended to optoisolator 18. The output of the optoisolator is extended to the T1 test input of the microprocessor. The Intel 8749 microprocessor has bidirectional ports; the bit positions in the ports can serve as inputs or outputs depending upon the instruction being executed. The microprocessor also has test inputs, of which T1 is one, which while not bidirectional are faster. When input T1 is tested, the microprocessor can determine whether the potential across the "armed" terminals in the installed panel is high or low. The reason for using bridge 16 is that over a wide range of inputs, the T1 input will be forced low; otherwise it is held high. A DIP switch DS2-POL is set by the installer so as to inform the microprocessor whether a high potential at the T1 input represents an armed or a disarmed condition. The installer can determine this and set the DIP switch appropriately simply by testing the potential across the "armed" terminals of the installed panel.

The terminals of the installed panel which are connected to the loop, and which are broken at points X—X in FIG. 1, are connected to the contacts of relay K1 as shown in FIG. 2. A resistor 20 simulates the end-of-line resistor. If the installed system includes such a resistor, the installed panel expects to see it in the line and DIP switch DS3 is opened. If there is no end of line resistor, the DIP switch is closed. It is in this way that the installed panel is made to "think" that it is still connected across the loop of the alarm system. As long as the microprocessor determines that there is no alarm condition, the D6 data output of the microprocessor is held low, transistor 14 conducts, and relay K1 is energized; with the closing of the relay contacts, a closed loop is simulated. When an alarm condition is sensed by the control unit, relay K1 is de-energized by causing data output bit D6 to go low. As will be described when considering the flow charts below, the owner of the system is given an option whether to have the installed panel informed of the alarm condition immediately upon its detection, or whether to delay informing the installed panel until the alarm condition is verified. Thus there may be a short delay between the sensing of an alarm condition and the actual opening of the simulated loop. DIP switch DS1-DELAY in the system of FIG. 2 is set by the installer to indicate whether a delay is to be tolerated while the verification sequence proceeds.

Tracer panel 12 is provided with three 7-segment LED displays. One of these serves as a "status" indicator. The other two serve to identify a "location." The meaning of the terms will be described below. There are also two light emitting diodes, labelled "alarm" and "armed" on tracer panel 12; these serve the conventional functions of indicating whether an alarm condition exists, and whether the system is armed to report a break.

Also on the tracer panel 12 are two push-button switches labelled "history" and "bypass." Operation of the former causes the control unit to enter a sequence during which a serviceman is provided with a summary of the overall past performance of the system, as will be described. Operation of the "bypass" push-button enables the system to be armed despite the fact that one or more switches are open, and the system will still operate properly to identify additional switches which may open and to inform the installed panel of such an alarm condition. The operation of the various indicators and controls on the tracer panel will be described below.

Port bits P10–P17, P20–P21 and P22 control all tracer panel indications, and also the reading of four switches—DS1-DELAY, DS2-POL, history and bypass. There are many ways in which this can be accomplished, and the details are not shown in the drawing since they would simply complicate the drawing and show nothing more than only one scheme of many which are known to those skilled in the art. However, a brief description of a preferred scheme will be given.

Port bits P10–P17 are extended to the input of an 8-bit latch provided in tracer panel 12. Seven of the latch outputs are used to determine whether the seven segments of a particular one of the three display elements are to be energized. The eighth bit output is used to control illumination of one of the light emitting diodes.

(The "alarm" light emitting diode is illuminated, if necessary, together with the segments of the status display. The "armed" light emitting diode is illuminated, if necessary, together with the left "location" display. The eighth bit of the latch is not used to control illumination of any light emitting diode when the right "location" display is operated upon.)

Eight bits are outputted on port 1 of the microprocessor in order to set the latch (not shown), and the latch itself is controlled to be set by these bits and to output the data in accordance with port bits P20 and P21. Port bits P15, P16 and P17 are also used to drive the three display elements, and the two light emitting diodes which are associated with two of them, as described above. This multiplexing type of operation is standard in the art for controlling displays.

Also, port bits P14–P17 are extended through respective diodes as shown in FIG. 2 to the four switches which must be interrogated. The other end of each of the four switches is connected to port bit P22. By pulling the port low and examining the potentials in sequence at port bits P14–P17, the microprocessor is able to determine which, if any, of the switches is closed.

As mentioned above, it is to be emphasized that the actual connections for controlling a display and reading status (switch) information is so standard in the art that the details are totally unimportant. What is important is how the tracer panel is used by an installer/serviceman and how it conveys information; these human engineering aspects of the invention, and the software for controlling them, will be discussed below.

Timers 24 depicted in FIG. 2 serve a standard function. It is possible that a microprocessor will go "haywire" and cease to function properly. In such a case, it is necessary to reset it in the hope that proper operation will resume. The microprocessor is programmed, at the "background" level, to pulse port bit P24 at intervals of 1 millisecond. Timers 24 check that a pulse occurs no sooner than 0.9 milliseconds subsequent to the previous pulse, and no more than 1.1 milliseconds after it. As long as both conditions are always satisfied, the reset input of the microprocessor is not forced low. But if any pulsing of the timers is premature, or if 1.1 milliseconds go by without a pulse being sensed, the microprocessor is reset. This kind of "sanity" timer operation is standard in the art.

Not all of the microprocessor inputs and outputs are shown. Only those necessary for an understanding of the invention are depicted. Interrupts are not utilized, and thus the interrupt input of the microprocessor is disabled. There is no external memory necessary (the microprocessor includes sufficient ROM and RAM to accommodate all of the programming necessary to implement the flow charts to be described below). The crystal connections are standard; the microprocessor is run at a clock rate of 11 MHz. The only other inputs and outputs of the microprocessor which must be considered are data bits D0, D1, D2 and D7 (all used as outputs only), test input T0, and port bit P27 which is used as an output.

Port bit 27 is connected to the plus input of voltage follower 36. Zener diode 34 serves to apply a constant potential to this input of the voltage follower when the port bit is high. The feedback arrangement which connects the emitter of transistor 38 to the minus input of the voltage follower causes the two inputs of the voltage follower to be at the same potential. Thus the feedback arrangement causes the voltage across resistor 40 to be the same as that across the Zener diode. This, in turn, means that the current which flows through resistor 40 and transistor 38 is determined by the ratio of the voltage of the Zener diode and the impedance of resistor 40. The current which flows through transistor 38 comes from the loop, as seen in FIG. 2. Resistors 50 and 52 are relatively large in magnitude compared with resistor 40 and thus draw relatively little current. The loop current in the quiescent condition is 2 milliamperes and almost all of it flows through transistor 38. At intervals to be described below, the microprocessor causes transistor 38 to turn off and the loop current to cease.

In the illustrative embodiment of the invention, alarm conditions as well as module identifications are determined by sensing the potential across the loop. One end of the loop is held at 35 volts, and the other end of the loop will be at the same potential if all of the switches are closed (in the absence of the EOL resistor). Resistors 50 and 52 serve to divide down the voltage; the resulting voltage at the input of programmable comparator 54 is sensed and indicates the line condition. It is when the potential changes that there is an indication that a switch is open or that an identification module is responding to a poll. For each switch which is open, the junction of the collector of transistor 38 and resistor 50 is less than 35 volts by 5 volts. During the polling process, as will be described below, whenever an identification module which is across an open switch is interrogated, it causes the potential across the loop to increase momentarily by 2 volts and this is detected by the programmable comparator 54.

The function of the programmable comparator is that of an analog-to-digital converter; it senses the analog voltage at the junction of resistors 50 and 52, and furnishes a digital representation to the microprocessor. An A/D converter is not used, however, because it would be too slow. Instead, a National Semiconductor ADC 0852 programmable comparator is used. The comparator is connected to the microprocessor by three inputs, and one output. The three inputs from the microprocessor are D2 (used to clock the comparator), D0 (used as the serial data input to the comparator), and D1 (used as a chip select); the comparator is set to an analog threshold level in accordance with a serial data code which is transmitted by the microprocessor. Once the analog level is set, the comparator compares it with the potential at the junction of resistors 50 and 52. The output of the comparator, DO, which is connected to the T0 test input of the microprocessor, informs the microprocessor whether the sensed potential is above or below the threshold which was previously set.

The test voltage at the junction of resistors 50 and 52 is applied to the CH0 input of the comparator. The comparator has two ports CH0 and CH1, and the potential at either one can control the level of the DO output. The state of the channel select input determines which channel is operative and this, in turn, is determined by the data loaded into the comparator via the DO output of the microprocessor. The chip select input of the comparator is used to enable the comparator or to reset it.

The channel 0 input is the "main" input in the sense that the potential at this input reflects the state of the loop. Channel 1 is used for another purpose. It will be noted that while the right end of resistor 58 is connected to the circuit ground, the junction of resistors 56 and 58 is connected to earth ground. Thus the potential at the junction of the two resistors, which is sensed at the channel 1 input and is a measure of the potential relative to the circuit ground, is the difference between the earth and circuit ground potentials. If the earth and circuit grounds are different, it is an indication that the wire loop is shorted somewhere to earth ground. This in and of itself is not "disastrous" and the system could still function. But if another short to earth ground takes place, it is possible that a big section of the wire loop will thus be bypassed. It is for this reason that if the potential at the channel 1 input of the comparator exceeds a threshold level when it is tested, appropriate measures are taken, as will be described below.

Switcher 26 serves to connect the two ends of line 100 to the 35-volt potential or the collector of transistor 38 in one of two different polarities, depending on the state of output bit D7 of the microprocessor, so that current can flow in either direction through the loop. As will be described below, this is a very important part of the invention in one embodiment. The switcher is a standard electronic element which simulates a double-pole, double-throw switch. The protection circuit 28, comprising a resistor and two back-to-back Zener diodes, simply serves to protect the system against large voltages which may arise in the loop as a result of lightning and the like. If the potential across the loop exceeds a threshold value, one of the Zener diodes conducts and prevents a large potential from being extended to the collector of transistor 38, or from developing across an IDM whose switch is open.

The representation in FIG. 3 will permit a very brief description of the manner in which the loop condition can be sensed in accordance with the potential at the collector of transistor 38. It will be understood that the actual potential which is monitored is that which is at the junction of resistors 50 and 52, but the potential at the collector of transistor 38 is a "test point" in the sense that all information about the loop can be derived from its value. If the loop is operating properly, there is typically a 4-volt potential across it. All of the switches are in effect short circuits, and if the EOL resistor has a magnitude of 2 kilohms, the 2-milliampere current in the line causes a 4-volt drop. Thus the test point is at a potential of 31 volts. An increase in the potential at the test point is an indication that the voltage across the loop has decreased; the drop across the loop is less than 4 volts. This is an indication of a short across the line, the EOL resistor somehow being shorted out of the loop. On the other hand, a decrease in the test point voltage results from an increase in the potential across the loop. This can arise in two ways. Either the loop itself is completely open (in which case the test point voltage drops to ground), or one or more switches are open, in which case the additional drop within the loop causes the voltage at the test point to be lower than the quiescent 31 volts. In the latter case, a scanning sequence ensues, and whenever an identification module responds to a query, the drop across it decreases. This means that the drop across the loop decreases and the potential at the test points increases. It is a potential increase at the test point during the scanning sequence that is an indication of a response by the module being addressed.

The use of a programmable comparator in the manner described is important. It would be possible to use a conventional-type analog-to-digital converter to check the loop voltage. However, in order to operate at a satisfactory speed, as will become apparent below, there are no more than about 50–100 microseconds to repeatedly examine the potential at the collector of transistor 38. This would necessitate the use of an expensive "flash" analog-to-digital converter. A programmable comparator, on the other hand, requires a relatively long time to set up, but its response time is in the order of only one microsecond; moreover, it is an inexpensive device. Because the alarm loop is in effect an antenna, there is a considerable amount of noise on it, and the potential at the test point must be "debounced." In other words, the potential at the test point, while for most of the time on one side of a threshold level, can actually exceed the threshold in the other direction momentarily. One way to compensate for this is to take multiple readings and to form an average of the results. A programmable comparator allows a reading to be taken in about one microsecond, so that even multiple readings can be taken in a very short time.

Identification Modules

The identification module of FIG. 4 is connected, as symbolized by the numeral 102, across a conventional switch SW in the single-wire loop 100. The normal current flowing through the loop is 2 milliamperes, as indicated. With the switch in its normally closed condition, no current is diverted to the identification module. It is only when the switch opens, in the event of an alarm condition, that the current flows into diode bridge 104.

The identification module has two leads which are connected to the plus and minus outputs of the diode bridge. These leads can be connected directly across switch SW, but in this case care must be taken with respect to the polarity of the connection. The current flowing in the wire loop must be made to flow through resistor 106 in the direction shown. The diode bridge allows a connection to the wire loop without any concern being paid to polarity. No matter how the diode bridge is connected across switch SW, the current in the loop will flow in the proper direction through resistor 106.

Until switch SW opens, there is no potential drop across the inputs of the diode bridge. But when switch SW opens, the loop current flows through the bridge and resistor 106, as shown. At this time, 3.8 volts develop across the resistor. A potential of 5 volts develops across switch SW, the increase in potential being due to the 0.6-volt drop across each of the two active diodes in the bridge.

Until switch SW opens, the tracer panel (the central control) does not perform a module interrogation function. The 2-milliampere current in the wire loop flows continuously. It is only when any switch SW opens and 5 volts develops across it that the central control is informed of an alarm condition. It is at this time that the interrogation sequence begins. Prior to that, however, when the switch first opens, the identification module goes through a power-up sequence.

The voltage across resistor 106 is initially zero since no current flows through bridge 104. Capacitor 140 is initially discharged, but it begins to charge as current flows through diode 134. Capacitor 140 serves as the power supply for the identification module. Once it has charged to 3.2 volts, it serves to power the unit even when the tracer panel causes the current in the wire loop to momentarily cease flowing during an interrogation cycle. Until capacitor 140 charges, however, the +V power input of binary counter 150 is low in potential, and the counter is not powered. (The counter is a standard CD4024 CMOS device.) Current also flows through capacitor 142 and resistor 132. The reset input of the counter goes high at the start of the power-up sequence, as the counter is being powered. When the potential across capacitor 140 is high enough to power the counter, the reset input is still energized, so the counter is reset. Thereafter, as capacitor 142 continues to charge, the reset input of the counter falls in potential to release the counter. In this way, on power-up, the counter is reset with all of its Q1–Q7 outputs going low. (The quiescent voltage of 3.2 volts at the cathode of diode 134 is exhibited following charging of capacitor 140.)

With all of the counter outputs low, a low potential is extended through diodes D1–D5 and those of fuses F1–F5 which are not "blown" to inputs of NOR gates 122 and 126. Since the other input of gate 122 is grounded, its output is high. This causes the outputs of each of gates 120 and 114 to remain low, the output of gate 114 holding transistor 110 off. As for gate 126, although one of its inputs is held low by the counter outputs, the other input is connected through resistor 124 to the 3.8-volt potential at the output of bridge 104. Consequently, the output of gate 126, connected to the CLK (clock) input of the counter, remains low.

The control unit interrogates all of the identification modules connected to the wire loop by causing the loop current to momentarily cease for 1 millisecond, at 2-millisecond intervals. The total number of current cessations in this manner represents the address of the module being interrogated. Each module has a code determined by which of fuses F1–F5 are blown. For example, if fuses F2, F4 and F5 are blown, only outputs Q1 and Q3 of the counter remain logically operative, and the identification code is decimal 5 (corresponding to binary 00101). Each time that the current in the loop ceases, the output of the diode bridge drops from 3.8 volts to zero. The voltage across capacitor 140 still powers the counter (and the four NOR gates, although this is not shown). Diode 134 prevents the voltage across capacitor 140 from being fed back through resistor 124 to the connected input of gate 126. Consequently, each time that the current in the loop ceases to flow, both inputs of gate 126 are low and the output goes high. Counter 150 does not advance, however, until a negative edge appears at its clock input. It is only when the current in the loop resumes, and the output of gate 126 goes low again, that the counter is clocked and the count is incremented.

In the example considered above, with only fuses F1 and F3 remaining in the circuit, there is no change in the system operation when the Q1 output of the counter goes high following the first clock pulse. Although diode D1 no longer conducts, the low potential at the Q3 output is extended through diode D3 and fuse F3 to an input of each of gates 122 and 126. Similarly, following the second clock pulse, with the Q2 output of the counter being the only one which is high, both of diodes D1 and D3 extend low potentials to NOR gates 122 and 126. It is only after the fifth clock pulse that both the Q1 and Q3 outputs of the counter go high. At this time, instead of a low potential being extended from the counter outputs to inputs of gates 122 and 126, the 3.2-volt powering potential is extended through resistor 144 to the gates. The high potential at an input of gate 122 causes its output to go low. With both inputs of gate 114 now low, the output goes high and transistor 110 turns on. Instead of just resistor 106 being placed in the wire loop (through the diode bridge, if it is used), it is resistors 106 and 108 in parallel which are now in the circuit.

The end-of-loop resistor used in the single-wire loop has a value of 2,000 ohms. With a 2-milliampere current flowing through the loop and no switch open, a 4-volt potential develops across the loop output terminals of the control unit, with 35−4, or 31 volts appearing at the collector of transistor 38 in FIGS. 2 and 3. When switch SW first opens and resistor 106 is connected across the diode bridge, a 5-volt potential drop develops across the switch. The potential at the collector of transistor 18 thus falls from 31 to 26 volts, and this gives rise to the interrogation sequence in the first place. When the identification module associated with the open switch recognizes its address—5 in the case under consideration—and resistor 108 is placed in parallel with resistor 106, the same 2-milliampere current now causes less of a voltage drop. Instead of a 5-volt potential being reflected to the input of the diode bridge, it is only a 3-volt potential which is reflected. Thus the potential at the collector of transistor 18 rises by 2 volts to 28 volts, to indicate to the panel (via comparator 40 in FIG. 3) that the module being addressed is across an open switch.

The interrogation continues until all identification modules have been polled. The control unit continues to break the loop current at 2-millisecond intervals, with a duty cycle of 50%. It is necessary to insure that any identification module which has just responded is disabled from interfering with the subsequent polling as modules with higher addresses are interrogated.

When the output of gate 122 first goes low, it causes the output of gate 120 to go high. Resistor 118 and capacitor 116 comprise an RC network, and they require 1 millisecond for the junction to go high enough to force the output of gate 114 low. Thus transistor 110 conducts for only 1 millisecond, until the output of gate 114 is forced low again due to the charging of capacitor 116. Each identification module thus causes the potential across the wire loop to drop by 2 volts when it is polled, for only 1 millisecond.

It is also necessary to insure that the identification module which has just responded does not respond again during the overall polling sequence. It would otherwise do so whenever the Q1 and Q3 outputs of the counter are both high during subsequent counts. (With 5 fuses connected to each counter in the illustrative embodiment of the invention, up to 32 devices can be addressed. A module programmed to have an address of 5, in the absence of a way to prevent it, would also respond to addresses 7, 13, 15, 21, 23, 29 and 31.) This is prevented by the connection of the OR'ed counter outputs to an input of gate 126. The first time that there is an address-count match and a high potential is extended to gates 122 and 126, gate 126 is permanently disabled. Until there is a match, the gate operation is determined solely by the potential at the output of bridge 104. Each time that the current in the loop ceases, the output of gate 126 goes high, and the counter is clocked (i.e., its count is incremented) when the current in the loop resumes and the output of gate 126 goes low. But with a high potential now being extended through resistor 144 to an input of gate 126, its output is locked low. The CLK input of the counter no longer sees a negative edge when current flow in the wire loop resumes. Thus the counter cannot count any higher than its own address. It is this feature of stopping the counter when it reaches its address that permits setting of a module address by blowing (opening) any fuse whose position represents a 0 in the address and leaving any fuse whose position represents a 1 in the address.

It is in this manner that an identification module first causes a 5-volt increase in the potential across the wire loop to signal a break somewhere in the system, and then causes a 2-volt drop in the potential when the module is polled. All that remains to describe is how the module is reset at the end of an overall polling sequence. Without some way to start the system up again with a power-up sequence, counter 150 would remain locked.

What the control unit does following any complete interrogation sequence is to turn off the loop current for 100 milliseconds. This is a long enough time, as compared with the 1-millisecond intervals during which the loop current is inhibited when interrogating the modules, for capacitor 140 to discharge through resistor 138 sufficiently to no longer power the counter. Only after the 100-millisecond break does the current begin to flow once again. During the break, all modules lose power, even if they previously had power. (The only modules which would have had power are those which were connected across open switches.) As soon as the loop current starts to flow once again after the 100-millisecond break, those modules which are connected across closed switches remain unpowered since their inputs are shorted by the respective closed switches. It is only a module which is connected across an open switch, such as that just described, which has a 3.8-volt potential at the output of its bridge. The power-up sequence begins all over again, with counter 150 being reset as soon as capacitor 140 charges sufficiently to power the module.

A shortcoming of the identification module of FIG. 4 is that the potential across its input terminals is 5 volts when the switch across which the module is placed opens. With a 35-volt supply, this means that only 6 switches may be open at the same time if the respective modules are to respond to a polling sequence; if seven modules are open, the potential across each module will be less than 5 volts and erratic operation of the modules may result. In some systems, this is not a sufficient number. Moreover, while the original system was designed to operate at 35 volts, it may actually be better to operate the loop with only a 30-volt potential; in some localities, 30-volt systems can be installed by unlicensed personnel. A 30-volt supply would permit only 5 identification modules to be interrogated.

Solutions to this problem occur both at the module level and the system level. At the module level, a custom IC design approach is taken which allows a lower operating voltage to be used. This will be described in connection with FIG. 5, although as important as the fabrication process is the fact that an additional diode 152 is placed across the input and the diode bridge 104 of FIG. 4 is omitted. At the system level, the loop current is caused to alternate in direction both when looking for something wrong with the line, and during a scanning process when the individual identification modules are queried. The purpose of switcher 26 in FIG. 2 is to allow the alternation in the direction of the loop current under the control of the microprocessor.

In FIG. 4, the cathode of diode 134 is shown at 3.2 volts when the alarm switch is open. This voltage is dictated by the +V requirements of the CMOS logic gates used. This potential is extended back to the input of the module and is a primary reason why the drop across the module is so high when the module is powered. A custom design allows a lower potential to be used, and the module of FIG. 5 is shown as having a potential of only 1.4 volts at the cathode of diode 134. Assuming that the drop across diode 134 is 0.6 volts, the drop across the overall module will be only 2 volts when it is powered, thus permitting many more powered modules to be interrogated. It will be noted, however, that diode bridge 104 is omitted in FIG. 5. It is the diode bridge which allows the module to be placed across an alarm switch without paying attention to the polarity of the module. It is diode 152 in the module of FIG. 5 which permits the module to be placed across a switch in either direction—provided that switcher 26 of FIG. 2 is operated as will be described.

If the module is placed across the alarm switch with the polarity shown in FIG. 5, when the line current flows in the direction shown diode 152 will not conduct, and the module will operate as previously described—except that there will be only a 2-volt drop across the (open) switch. When the module is polled, and a transistor comparable to transistor 110 in FIG. 4 turns on, the drop across the switch may decrease from 2 volts to only 1 volt, with the 1-volt change at the test point still being sufficient to sense a module response. If the module is placed across the switch with the opposite polarity, however, it will be apparent that when the alarm switch opens, the loop current will simply flow through diode 152. There will be a 0.6-volt drop across the switch, but it will be a constant drop and the module will not be able to respond when it is its turn to do so.

Consider a system in which there is a plurality of modules poled in the direction shown in FIG. 5, and another plurality of modules poled in the opposite direction. All of the modules poled in the first polarity operate exactly as described in connection with the module of FIG. 4. When the 2-milliampere loop current flows in the direction shown in FIG. 5, all of the other modules, assuming that their respective switches are open, conduct the current through their input diodes 152. These modules are not clocked and do not count current pulses when the current flows in the direction shown in FIG. 5. Only the modules which are poled as shown in FIG. 5 respond to the current pulses.

On the other hand, for all of the current pulses in the loop in the opposite direction, it is the other group of modules which respond. Modules such as that shown in FIG. 5 simply bypass the loop current across their open switches through diodes 152. In effect, there are two independent groups of modules, each group responding to current pulses of a different polarity and ignoring currents of the other polarity.

Using a custom design IC reduces the voltage drop of each module. Eliminating the diode bridge further reduces the voltage drop considerably, but requires that the installer pay attention to polarity—something which is preferably avoided. Adding a diode 152 but causing the loop current to reverse polarity solves this problem.

It is interesting to consider how many modules can respond with the scheme described. (It is to be remembered that the only time a module responds at all is when the switch across which it is connected is open. It is the voltage drops of only these modules which are of concern.) It is assumed that the voltage drop across a module such as that shown in FIG. 5 is 2 volts, and the voltage drop across a module whose polarity is reversed is simply that across diode 152, which for illustrative purposes will be considered to be at the high end, 0.7 volts. Let it be assumed that with a 35-volt supply, the maximum voltage drop across modules (which are across open switches) is to be 30.3 volts, thus still allowing sufficient potential across the loop to allow for end-of-line and loop resistances. It is assumed that the modules are placed in the loop randomly by the installer who does not pay attention to polarity. It is apparent that if there are 15 modules of the same polarity which are across open switches, they will contribute a potential drop of 30 volts when the current which flows is in the direction which allows their interrogation. There can be no modules of the opposite polarity across open switches because even one of them would provide an additional voltage drop of 0.7 volts, which would increase the total potential drop to 30.7 volts, which exceeds the 30.3-volt limit set in this example.

Consider next the situation in which there are 8 modules of the same polarity across open switches. When the current flows in the direction which produces a 2-volt drop across all of these modules, together they will contribute a 16-volt drop across the line. There may be up to 20 modules of the opposite polarity across switches which are open at the same time because for the same direction of current they will contribute (20)(0.7) or 14 volts; the 14 volts across the modules of one polarity and the 20 volts across the modules of the other polarity will total only 30 volts. However, when the current flows through the loop in the opposite direction, these 20 modules will give rise to a total drop of 40 volts ($20\times2$), far in excess of the 30.3-volt maximum being considered in this example. Assuming that there are 8 modules of the first polarity across open switches, they will contribute only (8)(0.7) or a 5.6-volt drop when the current flows in the opposite direction. This allows up to 12 modules of the opposite polarity to provide 2-volt drops since in such a case there will be a total of $(12\times2)+(8\times0.7)$ or 29.6 volts. It is thus apparent that there can be 8 modules of one polarity and 12 modules of the other polarity across open switches at the same time without the total potential drop across all 20 modules exceeding 30.3 volts no matter what the direction of the current.

A similar analysis can be undertaken for each possible number of powered modules of each polarity. It can be shown that the maximum number of modules which can be interrogated under the assumed conditions is 22, with 11 modules of each polarity being placed across switches which are open. The important point, however, is that no matter what the combination of open switches associated with modules of each polarity, the minimum number of modules which can be interrogated without the voltage drop across the loop exceeding 30.3 volts is 15. In other words, if the installer randomly poles the devices and the alarm switches are open in the most "unlucky" combination possible, it will still be possible to interrogate at least 15 modules which are across open switches. It is rare that there will be more than 15 switches open at the same time and thus the polarity-switching technique of our invention allows interrogation of modules across all open switches in every practical application.

Because the two groups of modules respond to current pulses of different polarities, it is possible to have identical addresses for two modules with opposite polarities. However, this is not desirable because if a module is removed and then re-installed in the opposite polarity, there might be two modules with the same address which would attempt to respond to the same polarity current. Therefore, it is preferred to have just a single series of addresses, regardless of the polarities of the installed modules.

Physical Construction Of Identification Modules And One Form Of Address Programmer FIG. 6A depicts the two parts, **160*a* and 160*b*, of an identification module of the type shown in FIG. 4. Part 160*a* consists of a plastic base 162 on which the various components are mounted, and part 160*b*** is the cover.

A conventional alarm switch includes all of the parts shown in FIG. 6A, except the identification module which is shown by the numeral 164. At each end of the plastic base a metal part 168 is inserted. This piece has two lugs **168*a* and 168*b*. Lug 168*b* really serves a mechanical function; it secures the metal piece in place. It is lug 168*a* which is used to connect the terminal to one end of alarm switch 166. A terminal screw 170 screws into the plastic base and makes contact with part 168. The wire loop is connected to contact 168 via screw 170, the head of the screw being shown in FIG. 6B which depicts the other side of the plastic base 162**.

It is thus apparent that in order to furnish conventional alarm switches with pre-packaged identification modules in parallel with the switches themselves, all that is necessary is to place an identificaiton module within the switch housing, and to connect its two terminals to lugs **168*b*, as shown in FIG. 6A**. To the installer, an alarm switch equipped with an identification module is no different from a conventional alarm switch.

Referring to FIG. 4, it will be noted that in order to program the address of the module, external contact must be made at six points—the left side of each of fuses F1–F5, and the common connection at the other side of each of the fuses. The six terminals to which access must be had in order to blow selected fuses are shown in FIG. 6B by the numeral 172, the terminals being on the hidden side of module 164 in FIG. 6A. Two cutouts **174*a* and 174*b* in the plastic base 162** allow access to the six terminals.

It will be apparent that there are many ways to construct a gun which can program the address of a module. The operative tip of such a gun 180 is shown in FIG. 7A. It will be noted that there are two blocks **182*a*, 182*b* of different sizes. These blocks fit into the corresponding cut-outs 174*a*, 174*b* and insure that the six pins 184 which extend out of the blocks contact terminals 172 in the proper orientation. As for the gun itself, one of the pins contacts the common terminal 172** which is connected to one end of each of the fuses, and the other five pins are connected to respective other ends of the fuses. All the gun requires is a mechanism for setting a sufficiently high potential between the common pin and those of the other five associated with fuses which are to be blown. This can be accomplished with the use of thumbwheel switches.

A simple address programmer, or programming gun, which can be used with the module of FIGS. 6A and 6B, is shown in FIG. 7B. The programmer of FIG. 7B includes six pins 184 for connection to the six terminals 172 of the identification module 200. [FIG. 7B omits the fuses F1–F5 of FIG. 4 only to illustrate that the diodes D1–D5 themselves may act as fuses.] The programmer includes a 5-gang thumbwheel switch TS1–TS5, each representing a 0 or 1 in the address to be programmed.

The unit is powered by battery 206. In addition to allowing the programming of a module, the unit also enables an already programmed module to have its address read. With switch 204 open and all of switches TS1–TS5 closed, current flows from the battery through resistor 202, and through those switches and light emitting diodes LED1–LED5 connected to still intact fuses F1–F5. The respective light emitting diodes are illuminated.

In order to program a new identification modules, switch 204 is closed after the thumbwheel switch is set in the desired pattern. By bypassing resistor 202, a much larger current flows, a current sufficient to blow any fuse through which it passes. The light emitting diodes themselves are not damaged in the programming process because each light emitting diode is in fact a parallel array of diodes, each parallel group being able to carry together the current which will blow a fuse.

The programmer of FIGS. 7A and 7B is very simple. (It also includes a battery charger which is not shown.) A more complicated programmer, one which can operate with the identification module of FIG. 8, will be described below.

The identification module of FIG. 8 allows an address to be programmed while the module is in the loop. This means that the module can be a two-terminal device which does not have to be accessed by the installer in order to program it. The construction of such an identification module is shown in FIG. 9. Again, it consists of two parts 190*a*, 190*b*. However, because there is no need to gain access to the identification module, it is not necessary to mount it directly on the plastic base 162 as in FIG. 6A, nor is it necessary to provide cut-outs in the plastic base in order to gain access to terminals from the other side. For this reason, identification module 192 is simply connected between the two lugs 168*a* in the same manner that the alarm switch 166 is so connected.

A Two-Terminal Module

While the physical construction of a two-terminal module is simple, the circuitry is more complex than that of a module such as the one of FIGS. 4 or 5. FIGS. 8A–8E show such a module.

A block diagram of the module appears in FIG. 8A. The numeral 310 identifies those components which are included in an integrated circuit. Circuits 336, 334 and 332 are shown respectively on FIGS. 8B–8D. The code store and detect circuitry of FIG. 8D includes nine cells labeled F/C-1 through F/C-9. A typical such cell, F/C-N, is shown in FIG. 8E. The integrated circuit is connected by four pads shown in FIG. 8A to various discrete circuit elements. A fifth pad 368 is shown in FIG. 8C, and this pad is connected by a discrete capacitor 362 and a discrete resistor 364 to the VDD and VSS system buses. Except for these two elements, and all of the discrete elements not included in integrated circuitry 310 of FIG. 8A, the complete circuit can be fabricated on a single chip.

In FIG. 8A, an alarm switch SWN is shown, together with a diode 300 which serves the same function as diode 152 in FIG. 5; the diode bypasses current of the "wrong" polarity. Resistor 302 is the resistor through which current in loop 100 flows to develop a potential drop across the module for indicating an alarm condition. When resistor 304 is shorted through the "out" pad and transistors 312 and 314 to the VSS line connected to the other side of the switch, the voltage drop decreases, and it is in this way that the IDM responds to a poll. When the IDM recognizes its count (address), conductor 342 is forced high to insert resistor 304 in the circuit.

Diode 300 may be a Zener diode, although such is not shown. The Zener diode would be poled in the same direction. Under normal conditions, it would function as a diode. But it would serve in the additional capacity of protecting the module if the voltage exceeds a threshold level, for example, 10 volts.

The voltage which develops across the module appears between the $\overline{CLK}$ pad and the VSS pad. The voltage is used as the VDD supply for all of the logic, with capacitor 306 serving as the supply capacitor. Diode 308 and capacitor 306 isolate the VDD line from the loop when the clock pulses appear on the loop, it being recalled that a clock pulse constitutes the cessation of current. In this manner, the integrated circuit sees an uninterrupted VDD supply.

Resistor 316, diode 318, transistor 322 and capacitor 324 function as a low-pass filter that eliminates spikes from the clock input. Transistor 322 serves as a resistor. The symbol ZP adjacent to a transistor in the drawing represents a 1-megohm P-channel resistor. Similarly, the symbol ZN represents a high impedence (1-megohm) N-channel device. The symbols WP and WN represent low impedence devices.

Further cleaning of the clock input is provided by the clock level detector 330. This circuit is a standard hysteresis latch. Its two complementary clock outputs are directed to the code store and detect circuitry 332 and the missing clock pulse detector 334. The purpose of the hysteresis circuit is to prevent chatter of the clock output due to low-amplitude noise so that clean clock pulses are derived for advancing the address counter.

The missing clock pulse detector 334 is shown in FIG. 8C. Whenever a pulse arrives, the current ceases for about 1 millisecond. A reset condition occurs when there is no current for 10 milliseconds. (When discrete components are used, a reset signal consists of a 100-millisecond cessation of current. With a custom integrated circuit, the reset time can be cut to 10 milliseconds.) The RST2 output of comparator 366 is normally low since the inverting input is connected through transistor 360 to the VDD line, while the VDD voltage is connected to the non-inverting input through a voltage divider. When the $\overline{CLK1}$ clock line goes low to cut off transistor 360, the non-inverting input of the comparator is still at the VDD level, since the junction of capacitor 362 and resistor 364 is initially at this potential. The capacitor starts to charge, however, thus lowering the potential at the inverting input of the comparator. During the 1-millisecond off time of the current, the capacitor does not discharge sufficiently to cause the RST2 output to go high. It takes 5 milliseconds for the capacitor to discharge sufficiently for the RST2 output to go high. Thus a reset condition is sensed when the loop current ceases for 10 milliseconds.

Referring back to FIG. 8A, it is apparent that when the RST2 signal goes high, the output of gate 338 goes low and the RST output of inverter 340 goes high. This is the reset signal for the code store and detect circuitry of FIG. 8D; all stages of the counter are reset. But there is an additional power-on reset circuit 336 which resets the circuit of FIG. 8D in an identical manner when the RST1 conductor goes high. The power-on reset circuit is shown in FIG. 8B. The purpose of this circuit is to provide a reset pulse during power-up that is long enough for VDD to stabilize. Initially, capacitor 356 is discharged and transistor 358 is off. The potential at node 354 is thus high and the RST1 line is high to control a reset. Capacitor 356 charges slowly until eventually transistor 358 conducts and node 354 goes low. The inverters included in the circuit rapidly cause transistor 350 to turn on, thus applying additional current to keep capacitor 356 charged. It is in this way that once node 354 goes low, it is held low until power is removed and then applied once again. While node 354 is low, the RST1 output is low and has no effect on the system operation. Capacitor 352 is provided to prevent transients from causing a reset pulse to appear.

The address counter on FIG. 8D is a 10-stage binary counter. The CLK1 and $\overline{\text{CLK1}}$ clock signals advance the least significant stage, with the ripple traveling through the counter. Thus the Q and $\overline{Q}$ outputs of the ten stages represent the number of clock pulses that were received since the last reset.

The address counter has two uses. First, it accumulates the clocked-in address for comparison with the internal address. Second, it is used initially to set the address that is to be programmed.

The address comparison function is best shown in FIG. 8E, the drawing being a schematic of a typical "fuse and compare" cell F/C-N. The complementary inputs Q and $\overline{Q}$ from the address counter are applied to respective dual AND gates 402/404 and 406/408. Also applied to these gates are the logical voltage levels determined by the fuse link 412. If the fuse is intact, the voltage on the VF line is high and represents a 1. If the fuse is blown, the VF voltage is low, the line being connected through transistor 398 to the VSS supply. (The transistor functions as a 1 megohm resistor.) The EQ output is low only if the bit represented by the respective counter stage does not match that represented by the condition of the fuse.

Suppose that the counter bit is a 1, with Q being high and $\overline{Q}$ being low. Transistor 406 is thus turned on. If the fuse is intact, representing a 1, the VF line will be high and the output of inverter 410 will hold transistor 408 off. Since the $\overline{Q}$ line is low, transistor 402 is off and the second AND gate cannot pull the EQ line low. Referring back to FIG. 8D, if the EQ lines of all nine cells are not pulled low, the VDD potential is extended through transistor (resistor) 374 to the EQ line 372. A similar analysis shows that if there is a mismatch between the bit represented by a cell fuse and the bit represented by the respective stage of the counter, the EQ output of FIG. 8E will be pulled low to prevent conductor 372 in FIG. 8B from going high to represent a match of the pulse count on the loop with the address of the IDM.

It is only if all nine bits match (there are really only eight bits that matter, as will be described below) that the cells F/C-1 through F/C-9 all allow line 372 to be held at the VDD supply level. This allows flip-flop 382 to be set on the next clock pulse and output conductor 342 to go high. It will be recalled that this is the conductor which, when it goes high, causes resistor 304 to be placed in the loop, thereby causing a drop in the voltage across the IDM.

Programming the address of the IDM is achieved by clocking in the desired address, then raising the current in the loop. Referring to FIG. 8E, it is when transistor 400 conducts while a sufficient current is being furnished to the IDM that a large enough current flows through fuse 412 to blow it. In order for the transistor to conduct, the output of gate 396 must go high. This in turn requires that its three inputs all be low. One of the inputs is connected to the Q output of the respective counter stage. Thus a fuse can be blown, to represent a 0, only if the respective counter stage represents a 0. The other two conditions for blowing a fuse are that the $\overline{\text{PE}}$ and $\overline{\text{HV}}$ lines also be low. These two lines, 392 and 394, have potentials which are derived from the circuitry on FIG. 8D.

The VDD potential is extended through resistor 378 and four serially connected transistors 380 to ground (VSS). These transistors act as a conventional Zener diode, conducting when the voltage across them exceeds 3 volts. If the VDD supply is below 3 volts, the $\overline{\text{HV}}$ line will be too high in potential and programming will not take place. It is only if VDD is high enough (above 8 volts) that the potential on the $\overline{\text{HV}}$ line is low enough to allow programming.

The IDM includes a tenth fuse F10 which is blown at the conclusion of the programming. Until the fuse is blown, the VDD potential is extended through the fuse to inverter 390 whose $\overline{\text{PE}}$ output is thus held low. This is what permits the programming to take place. As long as fuse F10 is intact, current flows through it and transistor (resistor) 388, with the potential at the input of the inverter being high enough to keep its output low. But after the programming, the output of gate 384 is caused to go high, turning on transistor 386. A large current flows and blows the fuse. It is at this time that the input of inverter 390 is returned to ground through resistor 388 so that no more programming can take place. In order to blow the fuse, after the programming circuit of FIG. 12 verifies that the proper address has been set in the IDM, it transmits 512 clock pulses. (This will be described in connection with FIGS. 14A–14B.) The last pulse causes the tenth stage of the address counter to switch to the 1 state and its $\overline{Q}$ output to go low. At this time both inputs of gate 384 are low and its output goes high to control blowing of fuse F10.

As will become clear below in connection with the flow chart which characterizes the operation of the programmer of FIG. 12, the individual bits of the IDM being operated upon are set during successive cycles. All of the bits are initially 1's since all of the fuses are initially intact. Only one fuse is blown at any given time. The switch across the IDM which is to be programmed is opened so that this is the only IDM which is powered. A number of pulses is sent whose binary value consists of seven 1s and one 0 (the ninth stage of the address counter is not used, as will be described below). Thus the Q output of only one of the eight stages is low in potential, and only the respective F/C cell can have its fuse blown. The programmer then sends out another pulse count whose binary value also represents seven 1s and one 0, the 0 being in a position whose corresponding F/C cell has a fuse which must be blown. It will be recalled that a fuse is actually blown by increasing the current in the loop. Theoretically, it might be possible to start with the lowest count and blow the fuse in the cell of least significance, advance the count to control blowing of the next fuse, increase the current, advance the count again, etc. However, supplying a large line current to the VDD bus in the integrated circuit can cause transients which might upset the states of the counters. It is for this reason that once a single fuse is blown, the programmer causes the current to cease so that the IDM can be reset, and another pulse count is generated for blowing another fuse.

The ninth stage of the address counter and the ninth F/C cell serve a totally different purpose. After the integrated circuit is made by the manufacturer, the fuse in the ninth cell is blown only to test whether the integrated circuit is functioning properly. The IDM is reset and 255 clock pulses are generated on the line. The first eight stages of the address counter thus represent 1s, and the ninth and tenth stages represent 0s. (The tenth stage does not enter into this discussion because all it controls is gate 384; it has no corresponding F/C cell.) A large current is applied to the device, and the fuse in the ninth F/C cell blows. The device is then reset and clock pulses are applied to the line. When a count of 255 is reached, the voltage across the IDM should drop as the EQ line goes low, thus indicating that the fuse in the ninth cell is blown (representing a 0). This is a sign that the integrated circuit is operating properly and that its fuses can be blown. Since the ninth cell is a permanent 0, the IDM can be programmed in the field to represent an address only up to 255. (Actually, an address of 255 does not require programming since this is the initial address; it is only other addresses which have one or more 0s in them.) The fact that the fuse in the ninth cell is blown by the manufacturer has no bearing on operation of the tenth stage of the address counter in the field, when 512 pulses are transmitted on the line after programming in order to blow fuse F10 to prevent any subsequent attempts at re-programming. The ninth stage of the address counter will function as any other stage, and the fact that there is a blown fuse in its respective cell when the IDM leaves the manufacturer is of no importance.

Alternative System Approaches

FIG. 10A depicts what we call an "unsupervised" system utilizing the modules of our invention (with or without current-direction switching). In this case, when at least one alarm switch opens the control unit interrogates all modules in order to determine which ones are across open switches. It should be appreciated that in the "unsupervised" system of FIG. 10A, if someone shorts a switch or an identification module (or the single housing which contains them both), this fact will not become known. The control unit will be unable to determine that there has been tampering with the switch because for all intents and purposes the shorted switch is closed. (A short across the loop itself, however, can still be detected due to provision of an EOL resistor.)

What is shown in FIG. 10B is what we called a "semi-supervised" loop. By placing a resistor in series with each switch, preferably within the same housing, with the identification module being placed across both in parallel, the shorting of the housing terminals will be detectable by the control unit. The potential drop across each identification module is no longer 0 volts even when the switch is closed because of the series resistor. If any identification module (or the parallel-connected switch housing) is shorted, the potential drop across its two terminals will decrease. This will be reflected at the test point and the system will be able to ascertain that one of the modules has been shorted. Because it is not possible to determine which one, since the module is shorted, we consider the switches to be only "semi-supervised." No EOL resistor is required in this configuration because a short anywhere will be detected through the shunting of the module resistances.

One problem with the scheme of FIG. 10B is that the number of identification modules which can be connected in the same serial line is limited. Suppose that the resolution of the control unit is 0.7 volts, that is, the system is capable of recognizing an instantaneous change of 0.7 volts at the test point. This means that the voltage drop across each identification module in FIG. 10B must be at least 0.7 volts or the shorting of the IDM will not be recognized. Obviously, there is a limit to the number of identification modules which can be included in the line; 43 of them produce a voltage drop across the loop in excess of 30 volts, and if the loop power supply is 30 volts to begin with, there could be no communication at all.

In accordance with the embodiment of our invention depicted in FIG. 11, the loop current is ordinarily 20 milliamperes (whether it flows in only one direction, or whether the control unit alternates the direction), as long as no switch is open. This allows the resistor used with each module in the system of FIG. 10B to be only 1/10th as large, and yet still contribute a drop of 0.7 volts which can be sensed at the test point in the event an identification module is shorted. Once a 0.7-volt increase at the test point is sensed, the control unit switches to a current magnitude of only 2 milliamperes. Now the resistor which is in series with each switch contributes an insignificant voltage drop (70 mv) and has almost no effect on the overall operation. A 2-milliampere current results in a 2.07-volt drop by any module which is connected across an open switch, and modules across open switches operate as described above. Modules which are across switches which are still closed do not change the system operation from that described above because each drops only 70 millivolts.

The control unit of FIG. 11 is identical to that of FIG. 2 with one difference. An additional resistor 210 can be placed in parallel with resistor 40, under control of port bit P24, via electronic switch 212 (shown symbolically). With the switch closed, 20 milliamperes flow through the loop due to the decreased impedance introduced by placing resistor 210 in parallel with resistor 40. With the switch open, the usual 2 milliamperes flow.

What triggers an alarm condition is the opening of a single switch. Despite the fact that small-magnitude resistors are used in series with each switch (in order that they not have a noticeable change in the system operation when the 2-milliampere current flows as described above), the shorting of an identification module will be noticeable because a large quiescent current flows until an alarm condition is sensed. The use of a 35-ohm resistor in each switch/module package, for example, allows semi-supervision in the sense that the shorting of some module may at least be sensed. Open switches can still be identified, but shorted switches cannot; the control unit can simply determine that there is at least one shorted switch. That is why the supervision is not complete.

The system arrangement shown in FIG. 10C permits full supervision. It will be noted that the switches in the system of FIG. 10C are normally open. With a 2-milliampere current flowing in each direction in an alternating fashion, every identification module will respond during each overall scanning sequence. A minimum of 15 modules can be accommodated (if they are all poled in the same direction), or 22 modules may be included in the line (if half are poled in each direction), taking into account the kind of analysis previously described. During each scanning cycle, every module is addressed and it responds by causing the voltage at the test point to increase by 1 volt. If any switch is closed, representing an alarm condition in this case, the associated module does not respond because it is shorted; this informs the control unit of an alarm condition. The system of FIG. 10C allows full supervision in the sense that the condition of every switch/module can be ascertained. Of course, the limitation of the system of FIG. 10C is that even if attention is paid to making sure that the modules of FIG. 5 are placed in the line so that there are equal numbers of both polarities, only 22 switches can have modules placed across them.

Although not shown in FIG. 10, the identification modules of our invention may also be placed in parallel across a 2-wire bus. In this case, each module is in series with a normally open switch. When any switch closes, the module is powered and can respond to a poll. (The central control obviously has to be different in this case.)

User Interface

Before proceeding with a description of the flow charts and a second form of address programmer, it will be helpful to define the interface of the user and the control unit. Referring to FIG. 2, it will be recalled that there is a 1-character status indicator, and a 2-character location indicator. There are also alarm and armed lights, and history and bypass switches.

In the normal condition, the alarm indicator is off and the status display is blank. The two location displays can be blank, although preferably they display a changing pattern just to indicate to the user that the system is "working." In the illustrative embodiment of the invention, line segments along the border of the combined location displays are successively illuminated so that a pattern appears to be running around the border. The armed indicator is illuminated if the system is armed, and not illuminated if the system is disarmed.

In the event of an alarm condition, what is shown on the tracer panel depends on the type of alarm. A "loop open" condition is one in which the entire loop is open or a switch without an identification module is open. In either case, no loop current flows. In addition to the alarm indicator being on, the status display depicts an O. The location display is blank. In the event of a shorted loop, resulting from a decrease in the voltage drop across the line and thus an increase in the potential at the test point, the alarm indicator is on and the location display is blank, but the now the status indicator depicts an S. In the event the loop is grounded, that is, it is connected to earth ground somewhere so that there is a potential difference between the earth ground and the circuit ground, the same conditions arise except that the status display depicts a G. A ground alarm condition does not trip the alarm, i.e., does not result in the opening of the contacts of relay K1, if the system is armed, because the protection has not really been compromised. But because of the potential difficulty, when a G appears on the status display, it prevents the system from being armed, by opening the contacts of relay K1 if the system is disarmed.

There is one more alarm condition which is also unrelated to individual switch performance. All processing is centered around the quiescent loop voltage, and that depends on the value of the EOL resistor, the length and gauge of the wire in the loop, and anything else which affects the impedance across the two ends of the loop. The impedance can change over time, for example, as the temperature varies. The software filters out low-frequency changes by adapting to a new quiescent loop potential; it is only faster changes which trigger responses. The software has an initial "window" that the loop voltage must fall within; if the loop voltage does not fall within this window at any time, there is what we call an "EOL" error. On power-up of the system, following either a power failure or a reset of the microprocessor, the software checks that the loop voltage falls within the window. If it does not, the alarm indicator is illuminated, and the three display elements depict the message EOL.

With a 2-milliampere quiescent current and a 2-kilohm loop impedance, the voltage drop across the loop should be 4 volts. If the drop is anywhere between 2 and 6 volts, the software adapts to this level and processing proceeds. Otherwise, the alarm condition which is displayed represents a problem with the end-of-line resistance.

It should be noted that in all cases described above, the armed indicator will be illuminated depending upon the incoming armed signal from the installed panel (see FIGS. 1 and 2).

With a single alarm switch open, the alarm indicator is illuminated and an L appears in the status display. The two-character location display depicts the address of the open alarm switch, that is, the address of the "active" identification module. In the event more than one alarm switch is open, the alarm indicator and the status display are the same, but now the addresses of the active identification modules appear successively, in numerical order, on the location display. A new address appears once per second, and the cycle is repetitive. Up to nine addresses can be displayed in the illustrative embodiment of the invention, but the actual number in any system depends upon the number of simultaneously open switches which can be expected and for which there can still be communication along the loop.

The bypass switch is used in connection with the following scenario. Suppose that the installed panel is disarmed, the control unit of the invention being informed of this over the armed line. If at this time a particular switch is open, the system should not be armed; if it is, the alarm will sound. The user knows that the switch is open because the alarm light is on, the status display depicts an L, and the location display depicts the location of the open switch. While arming of the system via the installed panel will sound the alarm, the pressing of the bypass switch causes the system to ignore the switch whose number is depicted on the location display. After the bypass switch is operated, the system may be armed by the installed panel and the open switch will be ignored. This feature allows the alarm system to be used even though there is an open switch which, for one reason or another, may not be repaired or which the user decides to ignore. If the bypass switch is operated and the system is not armed within 5 minutes, then the operation of the bypass switch is ignored and the command is ignored. Once the open switch is bypassed, however, the bypass command can be negated only by disarming the system via the installed panel, and then arming it again. Of course, by this time the open switch must be closed because arming of the system will result in an alarm condition if the switch is still open.

Because there is an open switch before the bypass mode is entered, the status display depicts an L. In fact, the bypass mode may not be entered unless there are one or more open switches, i.e., the status display depicts an L. [Also, the bypass mode may not be entered if the system is armed.] The location display depicts the address of the open switch. As soon as the bypass switch is momentarily operated, the L switches to a flashing b (representing "bypass"), and the system enters a "normal" condition; no address is depicted on the location display.

Suppose, however, that there are two or more open switches. In such a case, the addresses are repetitively depicted on the location display at 1-second intervals. The only way that the system can be armed without setting off the alarm is if all of the open switches are bypassed. In this case, in order to bypass all of the open switches, it is necessary to press the bypass switch once for each open alarm switch. The first time that the bypass switch is operated, the status display switches to a b, but it stays on and does not flash. Whichever address happened to have been depicted by the location display when the bypass switch was operated is effectively bypassed. The remaining open alarm switches have their addresses cycled on the location display. The next time that the bypass switch is operated, the alarm switch whose address happens to be displayed at that time will be bypassed. This process continues with the status display remaining a constantly illuminated b. After the last open alarm switch is bypassed with the pressing of the bypass switch as its address is depicted on the location display, the status display switches from a steady b to a flashing b, thus indicating that the system is in the bypass mode.

Once all of the open switches are bypassed, and as soon as the b indication starts to flash, all of the bypassed switches have their addresses cycled on the location display at a 1-per-second rate. In this way the user knows that some switches are bypassed when he sees the flashing b, and he can ascertain which they are by observing their addresses.

The history switch is designed to enable a serviceman to determine the cause of previous alarms. Pressing of the switch causes the status display to depict an H. At this time, the state of the alarm indicator depends upon whether there is an alarm condition and the status of the armed indicator depends on whether the system is armed or not. When in the history mode, the location display depicts the address of each alarm switch which caused an alarm condition while the system was armed. There is no logging of the opening of switches while the system is disarmed. The addresses of the logged alarm switches are cycled on the location display. However, each address is flashed a number of times equal to the number of times that the switch opened. In this way, the serviceman can ascertain not only which switches opened, but also how often each switch opened. After a single cycle, the system returns to the normal mode and the H symbol is no longer depicted in the status display. The flashing on and off of each address occurs at the rate of 2 per second. What is done is to depict the address of each alarm switch which opened for one second. Then the system depicts the number of times that the switch opened. The display is turned off for one-quarter of a second, turned on with the same address appearing for one-quarter of a second, turned off again, etc. Thus if the alarm switch associated with the identification module whose address is 5, for example, opened four times, the number 5 will be seen for one second, following which it will be flashed four times in a 2-second period. The display will then be blanked for one second, following which the address of another alarm switch will be shown for one second, followed by flashing of the number of times which it opened.

The history mode also displays alarm conditions not associated with identification modules. These are displayed by their associated letters (O, S and G) instead of an address. If, for example, three occurrences of an alarm due to an open loop were detected, the location display flashes an O three times (after first flashing the addresses of identification modules whose associated alarm switches may have opened). Similar remarks apply to the S and G flashing, in the order O, S and G.

The history data accumulates continuously. The data can be erased by pressing the two panel switches (Bypass and History) in a predetermined sequence; any sequence which is not likely to occur accidentally may be used.

There is one more mode of system operation, and that is the test mode—entered by pressing the history and bypass switches together, followed by pressing the bypass switch three times within three seconds. There are five tests which can be selected, and as soon as the bypass switch is pressed for the third time within three seconds, the status display scrolls the numbers 0 through 5 repetitively. Pressing the bypass switch again will cause an entry to the test whose number is being displayed at that time. Selecting the 0 test returns the system to normal operation, i.e., an exit of the test mode. Once the system is in any of the five tests, pressing of the history and bypass switches together returns the system to the test selection menu, during which the numbers 0 through 5 are scrolled on the status display.

Test number 1 involves the representation in the three displays of three digits which indicate the value of the loop voltage in the positive current direction. (The positive current direction is simply an arbitrary direction.) The value represented is in the range 000–255. Test number 2 is the same, except it involves the potential across the loop when the quiescent current flows in the other direction. The two readings are not necessarily the same because the number of open switches of each polarity may be different. Also, the resistors used in the identification modules for causing a voltage drop across the module may have different values since they typically have a 5% tolerance.

Test number 3 is simply a "digit test"; all segments of the three displays and the two indicators are illuminated.

Test number 4 displays the polarities of the active identification modules. The status display is blank for positive polarity identification modules; while the status display is blank, the addresses of the identification modules which are across open switches are depicted on the location display. Then the status display is caused to depict a minus, representing negative polarity, while the addresses of the open switches of this polarity are cycled on the location display.

Test number 5 simply causes the location displays to depict the revision level of the software, since it is expected that in any practical system the software will be revised periodically.

A Second Form Of Address Programmer

The programmer of FIG. 12 is designed to operate with identification modules of the type shown in FIGS. 8 and 9. In order to provide addresses for the identification modules in the loop, the control unit is disconnected from the loop. Referring to FIG. 2, the two lines at the output of switcher 26 would be disconnected from the loop. Instead, the output lines 220 of the programmer of FIG. 12 are connected to the loop. The circuitry of the programmer of FIG. 12 is very similar to that of the control unit of FIG. 2.

The actual sequencing of the programmer will be described in detail below. The basic concept, however, is that all alarm switches are closed except for the alarm switch across which there is connected the identification module whose address is to be programmed. The programmer applies a series of current pulses to the line which permanently programs an address in the module. The programmer can also verify the address of a module (for example, one which has just been programmed) by scanning the module in the usual way; the module will respond when its address, represented by the current pulse count, appears on the loop.

The programmer is controlled by a microprocessor 222 which is powered by batteries 226 through regulator 249. The batteries can be recharged by charger 224. Low battery detector 230, connected to a port bit of the microprocessor, serves to inform the microprocessor when programming should not be attempted due to insufficient battery potential. Because at any time at most one module is supposed to be in the loop and has to be powered by the programmer power supply, there is no need for a 35-volt power supply as in FIG. 2. Instead, a 12-volt battery supply suffices.

The microprocessor includes a three-digit display 236 comparable to that on the tracer panel. The purpose of each digit will be described below in connection with the flow chart which depicts the sequencing of the programmer. There are also three button switches 238, 240 and 242 which control microprocessor operation. The first two allow an address to be set in the programmer. By pressing the "U" button, the address represented on the two rightmost digits of display 236 is incremented. Similarly, the "D" button controls decrementing of the address. It is by pressing one of these two buttons one or more times in succession that an address can be set in the programmer for controlling the setting of an address in the selected identification module. When the "P" button is operated, it informs the programmer to proceed with the actual programming of the module. Before doing so, as will be described, the programmer verifies that there is only one module which is connected across an open switch, and that that module does not already have an address; in such a case, the "OK" light emitting diode 251 is energized.

Another thing which the programmer does before actually generating the sequence of current pulses which programs a module is to check the polarity of the module. Current of the wrong polarity will simply be bypassed through the diode which is across the input terminals of the module, so the programmer must first determine the necessary current direction. It is for this reason that switcher 228 is provided. Depending upon the polarity of the bit output of the microprocessor to which conductor 244 is connected, either contacts A are closed or contacts B are closed, thus determining the direction of the current through the loop. While switcher 26 of FIG. 2 is an electronic device, switcher 228 of FIG. 12 is a double-pole double-throw mechanical relay; one reason for this is that the current pulses which are caused to flow through the loop in order to program a module have two different magnitudes—2 milliamperes and 100 milliamperes. The 2-milliampere current pulses cycle a counter in the module and serve as control pulses. It is the 100-milliampere pulses which serve to blow fuses. Since large currents have to flow, it is more economical to provide a relay switcher. Speed of switching is of no moment because the switcher has to operate at most only once for each module, at the beginning of the programming sequence, in order to insure the proper current polarity. The elements shown by circuit 232 are similar to those shown in FIG. 11, and these elements serve to control the 2-milliampere and 100-milliampere current levels.

The microprocessor in FIG. 12 also has to monitor the potential across the loop, just as the control unit of FIG. 2 has to monitor the loop potential. For example, the programmer can only determine the address of a module by sensing a response represented by a change in the loop potential. Instead of repeating the complete analog-to-digital circuitry of FIG. 2, it is shown only symbolically by the numeral 234 on FIG. 12; the actual integrated circuit is connected to the microprocessor over four lines just as in FIG. 2.

It will be appreciated that the programmer of FIG. 12 is very similar, from a hardware standpoint, to the control unit of FIG. 2. Operations of the devices, of course, are considerably different because they perform different functions. These differences will become apparent after first considering the flow charts which describe the control unit operation, and then the flow charts which describe the programmer operation.

Flow Charts For Control Unit Of FIG. 2—FIGS. 13A–13G

As shown on FIG. 13A, on power-up the control unit measures VLOOP+ and VLOOP−. These are simply the potentials across the loop with both polarities, i.e., with switcher 26 of FIG. 2 in its two positions. There is no significance to the signs+ and−; they simply are used to indicate the respective polarities. A test is then made to see whether both loop voltages are within a predefined window. If either voltage is too low or too high, there is a malfunction and it is not possible to monitor the alarm switches. The system first releases relay K1 and, as seen in FIG. 2, release of the relay provides an indication to the installed panel 10 that there is an alarm condition. Depending on whether the installed panel is armed or not, the appropriate action is taken. On the tracer panel 12, the status and the location LEDs are caused to control a display EOL. The alarm LED on the tracer panel is also illuminated to indicate the condition. The system then continues to measure the loop potential with both polarities to see if the system restores.

The window which is used as the measure for proper system operation assumes that all alarm switches are closed, that there are no shorts, etc. In other words, the predefined window assumes that the system is normal. When the system is first installed, the installer should not turn it on unless the loop is normal. Thus at the beginning, the window test will be passed. Subsequently, if there is a power outage, the batteries which are part of a typical installed panel will keep the system running until power is restored.

The two potentials which are measured are used as the references from now on. The last step in FIG. 13A is the setting of the VREF+ and VREF− potentials to equal the two measured values. As long as each measured loop voltage during subsequent processing does not differ from the respective reference value by more than 0.6 volts, it is an indication that no alarm condition exists; the opening of an alarm switch results in the associated IDM controlling a greater potential change in the loop and similarly, open, short and ground conditions cause larger potential changes. In fact, as will become apparent below, small changes actually result in the two reference potentials tracking the actual potentials across the loop. Thus, small changes due to such things as variations in humidity, etc. do not allow cumulative changes in the loop potential resulting from non-alarm conditions to exceed the threshold level which would indicate an alarm condition. The reason for the window test in FIG. 13A is that in the absence of the initial loop potential (with each polarity) at least falling within a predefined broad window, there is no reference which can be established as normal so that subsequent tracking of the loop potential is of any significance.

After the initial set-up in accordance with the flow chart of FIG. 13A, the main processing loop of FIGS. 13B and 13C is entered. At the start of the main processing loop, three subroutines are executed—display, bypass and ground. These will be discussed below. The control unit then tests whether the voltage across the loop is equal to the reference voltage. (Although not depicted, the test sequence is carried out for each polarity.) If the potential across the loop is equal to the reference potential, relay K1 is activated; activating the relay, as shown in FIG. 2, holds the contact of relay K1 closed so that the installed panel "sees" a line with no trouble. The processing of the main loop then begins all over again. On the other hand, if the voltage across the loop is not equal to the reference, a test is made to see whether the difference (absolute value) is more than 0.6 volts. If the difference is small, thus not reflecting trouble in the loop, all that is done is to set the reference voltage to the actual loop potential. Everything is in order, so relay K1 remains energized and the processing continues as before.

If the difference in the loop potential is greater than 0.6 volts, it is an indication that there is something wrong. The control unit first checks to see whether there is a short in the loop and then whether the loop is open. If either condition exists, a branch is made to the report subroutine, after which the main processing begins all over again. But if there is no short, and the loop is not open, the control unit starts to poll the identification modules to see which of them is across an open alarm switch. The modules cannot be polled, however, until the actual loop potential (in each direction) is ascertained. The reason for this is that comparator 54 in FIG. 2 is set to a threshold level—midway between the present loop potential and the increased potential which will result when any module responds to its interrogation. Thus the present loop potential, which is a function of the number of alarm switches which are open, must first be measured. The way that the loop voltage is actually read is to do an 8-step binary search (since the comparator is an 8-bit device), a technique which is standard in the art.

After the loop voltage is determined and the comparator threshold is set, all of the identification modules are reset by causing the current to cease. Referring to FIG. 2, switch DS1 is the "delay" switch. If it is closed, it means that an alarm should be reported immediately (not shown in the flow chart); it is already known that at least one alarm switch is open. On the other hand, in most systems it is desired to delay reporting of an open alarm switch until some kind of verification is obtained to reduce the likelihood of false alarms. For this reason, a 700-millisecond timer is triggered. If prior to expiration of 700 milliseconds it is verified that an alarm switch is open, then an alarm condition is reported immediately, even if switch DS1 is open. On the other hand, if by the end of 700 milliseconds there is neither verification that an alarm switch is definitely open nor verification that all switches are closed, the alarm condition is reported. It is only if during the 700 milliseconds the system determines that no alarm switches are open (and switch DS1 is open) that the alarm condition is aborted and thus not reported.

The processing continues with the flow chart of FIG. 13C. The loop is pulsed once, in each direction, and a test is made to see if the loop voltage increases. If it does, the pulse number is logged to indicate that the IDM which has just been addressed is across an open alarm switch. A check is then made to see whether the loop has been pulsed the maximum number of times, 99, and if not another pulse is applied. (It is assumed that there are only 99 identification modules, although as described in connection with FIG. 8 each module in an installed system has an 8-bit address which can go as high as 255.) After all modules have been interrogated, they are all reset by causing the current to cease long enough to control the power-down of each module. An identical query sequence then follows, as shown in the middle part of FIG. 13C.

Finally, after the second query, the system checks to see whether any module responded during both query sequences. But that is not enough, in and of itself, to turn on the alarm. A B-table is maintained which lists all alarm switches which are to be bypassed. It is only if there a double-logged address which is not in the B-table that there is an alarm condition of concern. By turning on the alarm is meant that relay K1 is released and the alarm LED on the tracer panel is illuminated.

Before resuming at the start of the main processing loop, the control unit must determine whether any new addresses must be inserted in the H-file; the H-file is a file which contains the history of the system and will be the basis of the report rendered when the history switch on the tracer panel is operated. A test is first performed to see if the installed panel is armed in the first place; if it is not, there is no reason to insert anything in the H-file. A test is then made to see whether what has been detected is really a new alarm condition. The H-file which is maintained is not a complete file of all open alarm switches. Instead, the file consists of the identity and number of occurrences of each alarm switch which was the first to result in an alarm condition subsequent to the arming of the system. For each arming of the installed panel, there is at most one IDM listed in the H-file, and that is the IDM whose associated alarm switch was the first to open. The concern is for the first alarm switch to open and not all of them which may have opened, or have been opened, subsequently. The function of the H-file is to enable a technician to ascertain the alarm switch which is the cause of intermittent alarms, and in this regard it is only the first alarm switch which opens following initial arming of the system which is important.

This does not mean to say that an identification of all open switches is not important. On the contrary, as will be described, the system displays the addresses of all alarm switches which are open. It is only the H-file which is made to list the first alarm switch which opens following arming of the system, the H-file entries being displayed only when the history switch on the tracer panel is operated.

After a new address is logged in the H-file, assuming that the alarm is new, processing continues at the start of the main loop, with a return being made to the flow chart at the top of FIG. 13B.

It will be recalled that the very first thing which is done during the main processing is execution of the display subroutine. The flow chart of this subroutine as shown in FIG. 13D. A test is first made to see if the history switch is closed. If it is, it is an indication that a technician wants to examine the addresses in the H-file, and that these addresses should be displayed to the exclusion of any alarm conditions which may exist. A pointer is set to the IDM listed in the H-file whose address is the lowest. The tracer panel displays an "H" in the status LED and an address yy in the location indicator, where yy is the lowest address in the file. (As mentioned above, 8-bit addresses allow decimal addresses up to 255 to be displayed, whereas the panel of FIG. 2 only allows a maximum address of 99. The highest address N controlled by the software of FIG. 13C would be set to 99 for a tracer panel which includes only 2 digits for the location display; the panel used with a larger system would include 3 digits for the location display.)

After the system displays the address yy, it causes the address to flash at a 2-Hz rate. The address flashes a number of times equal to the number of occurrences of the address in the H-file, i.e., the technician is informed of the number of times that the subject alarm switch was the cause of an alarm condition. A test is then made to see whether there are any more IDM addresses which must be displayed. If there are, the pointer which retrieves an address from the H-file is incremented, and the next address is displayed. Otherwise, processing resumes with a test to see whether the system is armed.

If the system is armed the armed LED on the tracer panel is caused to be illuminated. Similarly, if an alarm condition exists, the alarm LED on the tracer panel is turned on. The display subroutine is then exited.

On the other hand, if the history switch is not closed when the subroutine is first entered, what is displayed is the origin of an alarm condition, if there is an alarm condition. The three alarm conditions—loop open, loop shorted, and loop grounded—are displayed with the relative priority shown in FIG. 13D. For example, if the loop is open, an "O" is displayed on the status LED to the exclusion of anything else. If none of the three conditions exist, a test if made to see whether there are any open alarm switches. If no IDM is active, the three LEDs on the tracer panel are made to display a "chase" pattern; this is simply a pattern to indicate that the system is working, there being no information to otherwise report.

On the other hand, if there are one or more active modules, a pointer is set to identify the first, and the resulting display is of the form L xx, where xx represents the address of the active IDM. The final two tests at the end of the flow chart on FIG. 13D are then performed in order to determine which, if any, of the armed and alarm LEDs should be turned on.

It should be noted that the L xx display is latched until the next time that the display subroutine is executed. Then, another IDM address will be displayed if there is another active IDM, or the same IDM address will be displayed if it is the only one. It is important to bear this in mind when considering the bypass subroutine of FIG. 13E because which, if any, alarm switch is bypassed depends upon which address is displayed at the particular time that the bypass switch is operated. It will be recalled that at the start of the flow chart of FIG. 13B, the bypass subroutine is executed immediately after the display subroutine.

The bypass subroutine of FIG. 13E is relatively simple. A check is first made whether the system has just been disarmed. If it has been, all entries in the B-table, the table which lists the alarm switches which should not trigger an alarm even when open, is zeroed; disarming the system deletes all entries so that the next time the system is armed all of the alarm switches will be capable of triggering alarms.

A test is then made to see if the bypass switch is closed. If it is not, the bypass subroutine is exited. Similarly, if the system is armed, the bypass subroutine is exited. The purpose of the bypass switch is to allow certain alarm switches to be taken out of the loop as far as polling is concerned. But once the system is armed, identification modules may not be taken out of the system by operation of the bypass switch. It is while the system is disarmed that entries may be placed in the B-table (which is consulted towards the end of the flow chart in FIG. 13C).

It will be recalled from a discussion of the flow chart of FIG. 13D that a different, active IDM is displayed during each main loop processing. If the bypass switch is operated while the address of an active IDM is displayed, then as indicated in FIG. 13E the address of that IDM is entered in the B-table. Either way, an exit is then made from the bypass subroutine.

Referring back to FIG. 13A, it will be noted that after execution of the bypass subroutine, the ground subroutine is executed, the flow chart being shown in FIG. 13F. If the loop is not grounded, no further actions take place. On the other hand, if the loop is grounded, a test is made to see if the system is armed. It will be recalled from the flow chart of FIG. 13D that alarm conditions result in the turning on of the alarm LED. But that is not the same as turning on the alarm, by which is meant that, in addition, relay K1 on FIG. 2 is released. In FIG. 13F, if the system is not armed, relay K1 is released. A ground is not that serious a condition that an alarm should be sounded. Thus, if the system is actually armed, the detection of a ground condition will not cause the alarm to be triggered, e.g., a call to a central station, etc.

At the end of the processing, the H-file is incremented to indicate that another loop ground has been sensed. As usual, the H-file (the register which contains the number of loop grounds) is incremented only if the detection of the loop ground is the first following the last arming of the system.

Referring to FIG. 13B, it will be noted that following the sensing of a short in the loop or the loop being open, the report subroutine is executed. This subroutine is shown in FIG. 13G. If the system is armed, a test is made to see whether the alarm condition has been sensed for the first time following arming. If it has, the respective register count in the H-file is incremented; otherwise, no action is taken since the condition has already resulted in the incrementing of the respective count. As shown in FIG. 13G, whether or not the system is armed, the alarm is turned on in the event of a short or a break in the loop. This is because these two conditions are much more severe than the ground condition handled by the subroutine of FIG. 13F.

Flow Charts For Programmer Of FIG. 8—FIGS. 14A–14B

Referring to FIGS. 12, 14A and 14B, on power-up the microprocessor causes a display of 888 for two seconds; this is simply an indication that the programmer is working properly. A check is then made to see whether the battery voltage is sufficient. If it is not, the display switches to LLL and no further processing takes place. If the battery voltage is sufficient, the display switches to 00 to indicate to the installer that further processing can take place. The numerical display generally represents the next address to be programmed. It is changed by pressing the up (U) or down (D) buttons.

First, a check is made to see whether either of the buttons is operated, an OR operation. Until something happens, the system just waits. When at least one of the buttons is operated, the system checks to see whether both of them have been operated. If both of them have been pressed, it is an indication that advance of the address to be programmed is to be under microprocesser control (semi-automatic), rather than under control of the installer (manual); in the semi-automatic mode, the installer does not have to operate either of the U or D buttons, or even the P button as will be described. The symbol yy in the flow chart represents the address to be programmed. The address is usually set equal to 01 by incrementing the initial address of 00; the programmer does this automatically if the U and D buttons are operated simultaneously; otherwise, the installer presses the U button once. The flow chart is basically the same for manual and semi-automatic modes, and the sequencing is most easily described by placing asterisks next to the four steps which have to be changed in the two sequences. The changes in these four steps will be described as the overall flow chart is described.

If the system is to be operated in the semi-automatic mode, determined by the U AND D test being answered affirmatively, yy is set equal to 00 and a return is made to see whether the U or D button is operated. But before the return, the program sequencing is modified. In the semi-automatic mode, the U OR D test is given a yes answer regardless of the actual condition of the buttons, and the U AND D test is given a negative answer regardless of the position of the buttons. Thus the next step which is executed is that in which the programmer counter is incremented or decremented. In the semi-automatic mode, the INC/DEC step is changed so that yy is automatically incremented. Thus during the first pass through the flow chart, the counter, which represents the address to be programmed, is incremented from 00 to 01, and the first address which is programmed is 01. During each pass thereafter, the counter is incremented automatically. In the manual mode, the installer operates the U or D button until the counter in the programmer represents the desired address. It is known which address will be programmed because, as indicated in the next step, the symbol Pyy is displayed, indicating that address yy is about to be programmed. (Although not shown, it is a trivial matter to allow incrementing of the counter, under normal control, to any desired starting address, after which the U and D buttons may be operated together to initiate semi-automatic programming starting with the designated address.)

The usual 2-milliampere loop current is then caused to flow, in one of the two directions, arbitrarily indicated to be the +polarity. A check is made to see whether the loop voltage is two volts. If it is not, a check is made to see whether the loop voltage is 0.6 volts, the potential which will be seen when the single alarm switch which is supposed to be open has an IDM whose polarity is opposite that of the loop current. If the loop potential is 0.6 volts, the polarity is reversed and the 2 volt test should now be passed. If the drop across the loop is neither 2 volts nor 0.6 volts, it is an indication that something is wrong and a "--" is displayed; the system simply hangs up and the continuous "--" display is an indication that some repair work is required. The installer must open the alarm switch whose IDM is to be programmed with an address. (The installer's intervention is necessary for this purpose even in the semi-automatic mode; that is why it is only "semi" automatic.) With only one alarm switch open, the loop voltage should be 2 volts (with the correct polarity) or 0.6 volts (with the incorrect polarity).

The programmer next checks that the IDM whose alarm switch is open does not already have an assigned address. The loop is pulsed in the usual way to see if an IDM responds. If none of the fuses in the IDM to be programmed has already been blown, its 8-bit address should be 11111111. When 255 pulses have been generated, the IDM should respond. If it responds to some other address zz, then the programmer displays Azz. This is an indication that the IDM, which the installer is attempting to program, already has an address assigned to it, address zz. The system remains locked at this display until the programmer is connected to another IDM.

If, on the other hand, the address of the IDM to be programmed is 255, indicating that it has not yet been programmed, the "OK" LED is turned on, and the previous display Pyy changes to a flashing display. This is an indication that the IDM whose alarm switch has been opened is about to be programmed with address yy.

The programming does not actually take place, however, until the P button is operated by the installer, as indicated at the top of FIG. 14B. In the semi-automatic mode, the first step in FIG. 14B is changed; the system advances to the N=−1 step even without operation of the button.

In either case, N, which represents the bit position in the binary address to be programmed is set equal to −1. The actual bit numbers vary from 0 through 7. After setting N=−1, the IDM is reset by causing the current to cease flowing in the loop. The bit position N is then incremented. Initially, N=0 so that the first bit of the address is programmed. The N=8 test fails, and the system determines whether the Nth bit in the address is to be programmed to a 0.

Depending upon the value yy, the system determines whether the Nth bit is to be set equal to a 0, i.e., whether the respective fuse is to be blown. If the bit is not to be set equal to 0, the IDM is reset, N is incremented, and the system determines whether the next bit in the address is to be a 0. Whenever a bit is to be set to a 0, each of the other seven bits is left a 1 in the address which is pulsed in order to blow a fuse. It will be recalled that in the preferred embodiment of the invention, only a single fuse is blown at any time. The necessary pulse count for an address is made to appear on the loop by pulsing the loop the number of times indicated in the flow chart. After the stages of the address counter have been placed in their desired state, the loop current is raised to blow the single fuse. The loop current is then lowered, the IDM is reset, and the process begins all over again on the next bit when N is incremented.

When N is incremented to 8, it is an indication that all 8 bits have been programmed. The IDM is reset, and the programmer now performs a check to verify that the address has been programmed properly. The loop is polled in the usual manner and the address of the IDM is read. The address is represented in the flow chart as xx. If xx=yy, the latter being the desired address, the IDM is reset and the loop is then pulsed 512 times. It will be recalled that pulsing loop 512 times sets up the IDM so that the tenth fuse will be blown, thus preventing any subsequent programming. After pulsing the loop 512 times, the loop current is raised so that the fuse will be blown, after which it is lowered to the usual 2 milliamperes. The IDM is then reset and the loop is polled once again to verify that the IDM address is still equal to the desired address yy. The address of the IDM is determined to be xx, and a test is then performed to see if xx=yy. If it does, a return is made to the flow chart of FIG. 14A. In the semi-automatic mode, the system falls through to the step at which yy is incremented and the next IDM is automatically programmed as soon as its respective alarm switch is opened and the voltage across the loop is 2 volts. It should be noted that until the installer can actually close the alarm switch across the IDM which has just been programmed, address (yy−1) will be read, i.e., the system will think that an attempt is being made to program an IDM whose address has already been programmed. The "error" message Azz will be displayed, where zz is equal to (yy−1). But as soon as the installer closes the alarm switch across the IDM which was just programmed, there will no longer be a drop across the loop. Even when the system attempts to reverse polarity, there will not be a 2-volt or a 0.6-volt drop and a "--" symbol will be displayed. As soon as the installer opens up an alarm switch across a new IDM, and provided that this IDM has not yet been programmed, programming will continue as described above.

Returning to FIG. 14B, it will be noted that there are two tests to see whether the IDM which has just been programmed has been programmed properly. If it has not, the address of the IDM, xx, is used to control a flashing error message, Exx. The system then waits to see whether either the U or the D button is operated. Semi-automatic programming ceases because an error has occurred. If either button is operated, a return is made to the flow chart of FIG. 14A, with all of the steps which were changed to effect semi-automatic programming reverting to the normal steps shown in the flow chart.

Although the invention has been described with reference to particular embodiments it is to be understood that these embodiments are merely illustrative of the application of the principles of the invention. Numerous modifications may be made therein and other arrangements may be devised without departing from the spirit and scope of the invention.

We claim:

1. An identification module for placement across a normally-closed alarm switch contained in a single-wire loop of an alarm system through which a current normally flows comprising means for representing a module address, means for diverting the loop current from said switch and for powering the module from the diverted current only when said switch is open, means for counting successive momentary interruptions in the loop current, and means responsive to the number of current interruptions corresponding to the module address for momentarily changing characteristics of the module seen by the loop current.

2. An identification module in accordance with claim 1 further including means for resetting said counting means responsive to said loop current ceasing for longer than a predetermined time interval followed by resumption of the powering of the module.

3. An identification module in accordance with claim 1 further including impedance means in the module for conducting the diverted current when said switch is open, and wherein said changing means changes the magnitude of said impedance means.

4. An identification module in accordance with claim 1 wherein said address representing means includes a plurality of fusible links.

5. An identification module in accordance with claim 1 wherein said address representing means includes a programmable memory, and means for programming said memory in accordance with a code represented by a current which flows along the loop and is diverted to the module while said switch is open.

6. An identification module for placement across a normally-closed alarm switch contained in a single-wire loop of an alarm system through which a current normally flows comprising means for representing a module address, means for diverting the loop current from said switch and for powering the module from the diverted current when said switch is in its open condition, means for counting successive momentary interruptions in the loop current, and means responsive to the number of current interruptions corresponding to the module address for momentarily changing characteristics of the module seen by the loop current.

7. An identification module in accordance with claim 6 further including means for resetting said counting means responsive to said loop current ceasing for longer than a predetermined time interval followed by resumption of the powering of the module.

8. An identification module in accordance with claim 6 further including impedance means in the module for conducting the diverted current when said switch is in its open condition, and wherein said changing means changes the magnitude of said impedance means.

9. An identification module for placement across an alarm switch contained in a single-wire loop of an alarm system through which a current normally flows comprising means for representing a module address, means for diverting the loop current from said switch and for powering the module from the diverted current only when said switch is open, means for counting successive momentary interruptions in the loop current, and means responsive to the number of current interruptions corresponding to the module address for momentarily changing characteristics of the module seen by the loop current.

10. An identification module in accordance with claim 9 further including means for resetting said counting means responsive to said loop current ceasing for longer than a predetermined time interval followed by resumption of the powering of the module.

11. An identification module in accordance with claim 9 further including impedance means in the module for conducting the diverted current when said switch is open, and wherein said changing means changes the magnitude of said impedance means.

12. An identification module in accordance with claim 9 wherein said address representing means includes a programmable memory, and means for programming said memory in accordance with a code represented by a current which flows along the loop and is diverted to the module while said switch is open.

13. An identification module for use in an alarm system by placement across an alarm switch comprising a pair of input terminals for connection across said switch, means responsive to said switch being open and the diversion of current through said input terminals for developing a potential to power the module, means for representing an address, means for counting the number of interruptions in the current flowing through said input terminals each of which is short enough to prevent power-down of the module, and means responsive to the instantaneous count matching the represented address for momentarily changing electrical characteristics of the module as seen looking into said input terminals.

14. An identification module in accordance with claim 13 further including means for preventing any interference by the module with the current flowing therethrough following a single operation of said changing means until the current ceases for a long enough interval to permit powering down of the module.

15. An identification module in accordance with claim 13 further including means for setting the address represented by said representing means in accordance with a code represented by a pulsed current which is diverted to the module while said switch is open.

16. A combined alarm switch/identification module for use in an alarm system comprising a housing; an alarm switch contained in said housing and having a pair of input put terminals; and circuit means contained in said housing connected across said pair of input terminals; said circuit means including means responsive to said alarm switch being open and the diversion of current through said circuit means for developing a potential to power the circuit means, means for representing an address, means for counting the number of interruptions in the current flowing through said circuit means each of which is short enough to prevent power-down of the circuit means, and means responsive to the instantaneous count matching the represented address for momentarily changing electrical characteristics of the circuit means as seen looking into said input terminals.

17. A combined alarm switch/identification module in accordance with claim 16 further including means in said circuit means for preventing any interference by the circuit means with the current flowing therethrough following a single operation of said changing means until the current ceases for a long enough interval to permit powering down of the circuit means.

18. An identification module in accordance with claim 16 further including means for setting the address represented by said representing means in accordance with a code represented by a pulsed current which flows between said pair of input terminals and which is diverted to the circuit means while said alarm switch is open.

19. A combined alarm switch/identification module for use in an alarm system comprising a housing; an alarm switch contained in said housing and having a pair of input terminals; and circuit means contained in said housing connected across said pair of input terminals; said circuit means including means responsive to said alarm switch being open and the diversion of current through said circuit means for developing a potential to power the circuit means, means for representing an address, means for recognizing an address code represented by the current flowing through said circuit means in a manner such that power-down of the circuit means is prevented, and means responsive to the recognized address code matching the represented address for momentarily changing electrical characteristics of the circuit means as seen looking into said input terminals.

20. A combined alarm switch/identification module in accordance with claim 19 further including means in said circuit means for preventing any interference by the circuit means with the current flowing therethrough following a single operation of said changing means until a predetermined change in the current occurs which is indicative of another cycle of operation.

21. An identification module in accordance with claim 19 further including means for setting the address represented by said representing means in accordance with a code represented by a pulsed current which flows between said pair of input terminals and which is diverted to the circuit means while said alarm switch is open.

22. A two-terminal module for use in a single-wire loop alarm system comprising a housing having two terminals, a switch contained in said housing connected between said two terminals, and identification means contained within said housing and connected between said two terminals for responding to an address transmitted over the loop in which the module is connected, said identification means including means for powering itself by quiescent current flowing through said terminals, means for counting current pulses in said loop and for comparing the number with a preassigned address, and means responsive to a match for changing electrical characteristics between the two terminals.

23. A module in accordance with claim 22 wherein said identification means is connected directly in parallel with said switch, and said switch is normally closed in the absence of an alarm condition.

24. A module in accordance with claim 22 wherein said switch is normally closed in the absence of an alarm condition and further including resistance means connected in series with said switch between said two terminals, and wherein said identification means is connected between said two terminals in parallel with the series connection of said switch and said resistance means.

25. A module in accordance with claim 22 wherein said identification means is connected directly in parallel with said switch, and said switch is normally open in the absence of an alarm condition.

26. A module in accordance with claim 22 wherein said identification means includes means responsive to a predetermined current condition in said loop for operating in a programming mode, and means responsive to a current pulse pattern appearing in said loop when the module is operating in said programming mode for assigning a corresponding address to the module.

27. A module in accordance with claim 22 further including a plurality of exposed terminals electrically connected to said identification means, and means responsive to the selective energization of said terminals for assigning an address to the module.

28. A single-wire loop alarm system comprising a central control; a wire loop whose ends terminate at said central control; a plurality of normally-closed alarm switches disposed along said loop; means in said central control for normally causing a fixed current to flow through said loop and the alarm switches disposed therealong; a plurality of identification modules each connected in parallel across a respective alarm switch, having means for representing a unique address, and including means responsive to a transmitted code corresponding to said unique address appearing on the loop when the respective alarm switch is open for changing a loop characteristic; means in said central control responsive to an increase in the loop impedance when an alarm switch is open for polling said modules by applying sequentially on said loop the codes corresponding to the module addresses; and means in said central control for registering those modules for which the loop characteristic changes responsive to the appearance on the loop of the corresponding transmitted code.

29. A single-wire loop alarm system in accordance with claim 28 wherein each of said identification modules is unpowered as long as the respective alarm switch is closed, and includes means for powering itself responsive to the opening of the respective alarm switch and the diversion of the loop current to the module.

30. A single-wire loop alarm system in accordance with claim 28 wherein each of said identification modules is a two-terminal device.

31. A single-wire loop alarm system in accordance with claim 28 wherein the transmitted codes are pulse counts, and the loop-characteristic changing means in each identification module includes means for recognizing a unique pulse count.

32. A single-wire loop alarm system in accordance with claim 31 wherein said loop-characteristic changing means in each identification module includes means for changing the impedance seen by the current flowing through said loop.

33. A single-wire loop alarm system in accordance with claim 28 wherein said central control can register the modules connected in parallel across at least six simultaneously open alarm switches.

34. A single-wire loop alarm system in accordance with claim 28 wherein said central control requires less than one second to poll at least thirty-two identification modules.

35. A single-wire loop alarm system in accordance with claim 28 further including means for registering an alarm condition when the loop impedance first increases with the opening of an alarm switch independent of whether all of the alarm switches disposed along the loop have identification modules connected in parallel.

36. A single-wire loop alarm system in accordance with claim 28 wherein said central control causes current to flow in only one direction through said loop, and each identification module includes means for rendering it polarity insensitive.

37. A single-wire loop alarm system in accordance with claim 28 wherein the address representing means in each identification module is a group of fusible links.

38. A single-wire loop alarm system in accordance with claim 28 wherein the address representing means in each identification module is a non-volatile memory which is programmable by current codes applied to the loop by the central control.

39. A single-wire loop alarm system in accordance with claim 28 further including a plurality of housings, each of said identification modules and its connected alarm switch being contained in a single housing.

40. A single-wire loop alarm system in accordance with claim 39 further including resistance means in each of said housings connected in series with the respective alarm switch, with the respective identification module being connected across the series connection of the alarm switch and the resistance means.

41. A single-wire loop alarm system in accordance with claim 28 wherein each of said identification modules is normally unpowered and further includes means responsive to the respective alarm switch being open and the diversion of current through the module for developing a potential to power the module, and wherein said loop-characteristic changing means includes means for counting the number of interruptions in the current flowing through the module each of which is short enough to prevent power-down of the module, and means responsive to the instantaneous count corresponding to the respective unique address of the module for momentarily changing the impedance presented by the module.

42. A single-wire loop alarm system in accordance with claim 41 further including means in each identification module for preventing any interference by the module with the current flowing therethrough following a single change in the impedance presented by the module until the loop current ceases for a long enough interval to permit powering down of the module.

43. A single-wire loop alarm system in accordance with claim 28 wherein said central control includes means for monitoring a potential which is indicative of the voltage drop across said loop; said potential increasing and decreasing as alarm switches open and close and as identification modules change their loop characteristics responsive to the polling thereof; said monitoring means including programmable comparator means, means for setting a threshold level in said programmable comparator means, and means for determining whether said potential is above or below said threshold level.

44. A single-wire loop alarm system in accordance with claim 28 wherein said central control includes means for executing a repetitive activity within repetitive prescribed windows of time, and means responsive to the failure to execute said activity within one of said windows of time for registering an alarm condition.

45. A single-wire loop alarm system comprising a central control; a wire loop whose ends terminate at said central control; a plurality of alarm switches disposed along said loop; a plurality of two-terminal identification modules each connected in parallel across a respective alarm switch, having means for representing a unique address, and including means responsive to a transmitted code corresponding to said unique address appearing on the loop when the respective alarm switch is open for changing its electrical characteristics; means in said central control for normally causing a fixed current to flow through said loop, and the alarm switches and identification modules disposed therealong; means in said central control responsive to a change in the loop impedance when an alarm switch changes state for polling said modules by applying sequentially on said loop the codes corresponding to the module addresses; and means in said central control for registering those modules for which the loop electrical characteristics change responsive to the appearance on the loop of the corresponding transmitted code.

46. A single-wire loop alarm system in accordance with claim 45 wherein each of said identification modules is unpowered when the respective alarm switch is closed, and includes means for powering itself when the respective alarm switch is open and the loop current is diverted to the module.

47. A single-wire loop alarm system in accordance with claim 45 wherein the transmitted codes are pulse counts, and the electrical-characteristics changing means in each identification module includes means for recognizing a unique pulse count.

48. A single-wire loop alarm system in accordance with claim 47 wherein said electrical-characteristic changing means in each identification module includes means for changing the impedance seen by the current flowing through said loop.

49. A single-wire loop alarm system in accordance with claim 45 wherein said central control can register the modules connected in parallel across at least six simultaneously open alarm switches.

50. A single-wire loop alarm system in accordance with claim 45 wherein said central control requires less than one second to poll at least thirty-two identification modules.

51. A single-wire loop alarm system in accordance with claim 45 further including means for registering an alarm condition when the loop impedance first changes with the change in state of an alarm switch independent of whether all of the alarm switches disposed along the loop have identification modules connected in parallel.

52. A single-wire loop alarm system in accordance with claim 45 wherein said central control causes current to flow in only one direction through said loop, and each identification module includes means for rendering it polarity insensitive.

53. A single-wire loop alarm system in accordance with claim 45 wherein the address representing means in each identification module is a group of fusible links.

54. A single-wire loop alarm system in accordance with claim 45 wherein the address representing means in each identification module is a non-volatile memory which is programmable by current codes applied to the loop by the central control.

55. A single-wire loop alarm system in accordance with claim 45 further including a plurality of housings, each of said identification modules and its connected alarm switch being contained in a single housing.

56. A single-wire loop alarm system in accordance with claim 55 further including resistance means in each of said housings connected in series with the respective alarm switch, with the respective identification module being connected across the series connection of the alarm switch and the resistance means.

57. A single-wire loop alarm system in accordance with claim 45 wherein each of said identification modules is normally unpowered and further includes means responsive to the respective alarm switch being open and the diversion of current through the module for developing a potential to power the module, and wherein said electrical-characteristics changing means includes means for counting the number of interruptions in the current flowing through the module each of which is short enough to prevent power-down of the module, and means responsive to the instantaneous count corresponding to the respective unique address of the module for momentarily changing the impedance presented by the module.

58. A single-wire loop alarm system in accordance with claim 57 further including means in each identification module for preventing any interference by the module with the current flowing therethrough following a single change in the impedance presented by the module until the loop current ceases for a long enough interval to permit powering down of the module.

59. A single-wire loop alarm system in accordance with claim 45 wherein said central control includes means for monitoring a potential which is indicative of the voltage drop across said loop; said potential increasing and decreasing as alarm switches open and close and as identification modules change their electrical characteristics responsive to the polling thereof; said monitoring means including programmable comparator means, means for setting a threshold level in said programmable comparator means, and means for determining whether said potential is above or below said threshold level.

60. A single-wire loop alarm system in accordance with claim 45 wherein said central control includes means for executing a repetitive activity within repetitive prescribed windows of time, and means responsive to the failure to execute said activity within one of said windows of time for registering an alarm condition.

61. A single-wire loop alarm system comprising a control unit; a wire loop whose two ends terminate at said control unit; a plurality of alarm switches disposed along said loop; a plurality of identification modules connected in parallel with respective ones of said alarm switches, some of said modules being responsive to current pulses in a first direction through said loop and others of said modules being responsive to current pulses in a second direction through said loop, all of said modules simply allowing the loop current to be bypassed if the current is in the direction for which the module is not responsive; means in said control unit for causing a direct current to flow through said loop alternating between the two directions for ascertaining if an alarm condition exists; means in said control unit responsive to the existence of an alarm condition for generating a series of current pulses in the loop, alternating between the two directions, for addressing individually said identification modules; each of said identification modules including means responsive to its individual addressing for changing its internal characteristics so as to affect the current flowing in said loop in a manner representative of its status; and means in said control unit for monitoring the current in said loop to determine the status of an addressed identification module.

62. A single-wire loop alarm system in accordance with claim 61 wherein said control unit monitoring means includes resistance means through which the loop current flows for developing a test potential, programmable comparator means which includes means for representing a programmable threshold level, and means for indicating if said test potential is above or below the represented threshold level.

63. A single-wire loop alarm system in accordance with claim 61 wherein each of said identification modules is unpowered when the respective alarm switch is closed, and includes means for powering itself when the respective alarm switch is open and the loop current is diverted to the module.

64. A single-wire loop alarm system in accordance with claim 61 wherein the generated codes are pulse counts, and the internal-characteristics changing means in each identification module includes means for recognizing a unique pulse count.

65. A single-wire loop alarm system in accordance with claim 64 wherein said internal-characteristics changing means in each identification module includes means for changing the impedance seen by the current flowing through said loop.

66. A single-wire loop alarm system in accordance with claim 61 wherein said control unit can register the modules connected in parallel across at least six simultaneously open alarm switches.

67. A single-wire loop alarm system in accordance with claim 61 wherein said control unit requires less than one second to poll at least thirty-two identification modules.

68. A single-wire loop alarm system in accordance with claim 61 further including means for registering an alarm condition when the loop impedance first changes with the change in state of an alarm switch independent of whether all of the alarm switches disposed along the loop have identification modules connected in parallel.

69. A single-wire loop alarm system in accordance with claim 61 wherein the address representing means in each identification module is a non-volatile memory which is programmable by current codes applied to the loop by the central control.

70. A single-wire loop alarm system in accordance with claim 61 further including a plurality of housings, each of said identification modules and its connected alarm switch being contained in a single housing.

71. A single-wire loop alarm system in accordance with claim 70 further including resistance means in each of said housings connected in series with the respective alarm switch, with the respective identification module being connected across the series connection of the alarm switch and the resistance means.

72. A single-wire loop alarm system in accordance with claim 61 wherein each of said identification modules is normally unpowered and further includes means responsive to the respective alarm switch being open and the diversion of current through the module for developing a potential to power the module, and wherein said internal-characteristics changing means includes means for counting the number of interruptions in the current flowing through the module each of which is short enough to prevent power-down of the module, and means responsive to the instantaneous count corresponding to the respective address of the module for momentarily changing the impedance presented by the module.

73. A single-wire loop alarm system in accordance with claim 72 further including means in each identification module for preventing any interference by the module with the current flowing therethrough following a single change in the impedance presented by the module until the loop current ceases for a long enough interval to permit powering down of the module.

74. A single-wire loop alarm system in accordance with claim 61 wherein said control unit includes means for monitoring a potential which is indicative of the voltage drop across said loop; said potential increasing and decreasing as alarm switches open and close and as identification modules change their internal characteristics responsive to the addressing thereof; said monitoring means including programmable comparator means, means for setting a threshold level in said programmable comparator means, and means for determining whether said potential is above or below said threshold level.

75. A single-wire loop alarm system in accordance with claim 61 wherein said control unit includes means for executing a repetitive activity within repetitive prescribed windows of time, and means responsive to the failure to execute said activity within one of said windows of time for registering an alarm condition.

76. A single-wire loop alarm system in accordance with claim 61 wherein each of said identification modules has an address different from those of all other modules regardless of the current directions for which said modules are responsive.

77. An alarm system comprising a control unit; a wire loop whose two ends terminate at said control unit; a plurality of alarm switches disposed along said loop; a plurality of identification modules connected in parallel with respective ones of said alarm switches, some of said modules being responsive to currents in a first direction through said loop and others of said modules being responsive to currents in a second direction through said loop, all of said modules simply allowing the loop current to be bypassed if the current is in the direction for which the module is not responsive; means in said control unit for causing a direct current to flow through said loop alternating between the two directions for ascertaining if an alarm condition exists; means in said control unit responsive to the existence of an alarm condition for generating a series of address codes in the loop, alternating between the two directions, for addressing individually said identification modules; each of said identification modules including means responsive to its individual addressing for changing the current flowing in said loop in a manner representative of its status; and means in said control unit for monitoring the current in said loop to determine the status of an addressed identification module.

78. An alarm system in accordance with claim 77 wherein said control unit monitoring means includes resistance means through which the loop current flows for developing a test potential, programmable comparator means which includes means for representing a programmable threshold level, and means for indicating if said test potential is above or below the represented threshold level.

79. An alarm system in accordance with claim 77 wherein each of said identification modules is unpowered when the respective alarm switch is closed, and includes means for powering itself when the respective alarm switch is open and the loop current is diverted to the module.

80. An alarm system in accordance with claim 77 wherein the generated address codes are pulse counts, and the changing means in each identification module includes means for recognizing a unique pulse count.

81. An alarm system in accordance with claim 80 wherein said changing means in each identification module includes means for changing the impedance seen by the current flowing through said loop.

82. An alarm system in accordance with claim 77 wherein said control unit can register the modules connected in parallel across at least six simultaneously open alarm switches.

83. An alarm system in accordance with claim 77 wherein said control unit requires less than one second to address at least thirty-two identification modules.

84. An alarm system in accordance with claim 77 further including means for registering an alarm condition when the loop impedance first changes with the change in state of an alarm switch independent of whether all of the alarm switches disposed along the loop have identification modules connected in parallel.

85. An alarm system in accordance with claim 77 further including a plurality of housings, each of said identification modules and its connected alarm switch being contained in a single housing.

86. An alarm system in accordance with claim 85 further including resistance means in each of said housings connected in series with the respective alarm switch, with the respective identification module being connected across the series connection of the alarm switch and the resistance means.

87. An alarm system in accordance with claim 77 wherein each of said identification modules is normally unpowered and further includes means responsive to the respective alarm switch being open and the diversion of current through the module for developing a potential to power the module, and wherein said changing means includes means for counting the number of interruptions in the current flowing through the module each of which is short enough to prevent power-down of the module, and means responsive to the instantaneous count corresponding to the respective address of the module for momentarily changing the impedance presented by the module.

88. An alarm system in accordance with claim 87 further including means in each identification module for preventing any interference by the module with the current flowing therethrough following a single change in the impedance presented by the module until the loop current ceases for a long enough interval to permit powering down of the module.

89. An alarm system in accordance with claim 77 wherein said control unit includes means for monitoring a potential which is indicative of the voltage drop across said loop; said potential increasing and decreasing as alarm switches open and close and as identification modules change the loop current responsive to the addressing thereof; said monitoring means including programmable comparator means, means for setting a threshold level in said programmable comparator means, and means for determining whether said potential is above or below said threshold level.

90. An alarm system in accordance with claim 77 wherein said control unit includes means for executing a repetitive activity within repetitive prescribed windows of time, and means responsive to the failure to execute said activity within one of said windows of time for registering an alarm condition.

91. An alarm system in accordance with claim 77 wherein each of said identification modules has an address different from those of all other modules regardless of the current directions for which said modules are responsive.

92. A single-wire loop alarm system comprising a control unit; a wire loop whose two ends terminate at said control unit; a plurality of normally-closed alarm switches disposed along said loop; a resistance in series with each of said normally-closed alarm switches; an identification module connected in parallel across each of said series connections of an alarm switch and a resistance; means in said control unit for causing a relatively large current to flow through said loop and for recognizing a change in potential across said loop as indicative of the opening of an alarm switch; each of said identification modules including means responsive to the diversion of current therethrough responsive to the opening of the associated alarm switch for powering the module; and means in said control unit responsive to the recognition of the opening of an alarm switch for reducing the magnitude of the current caused to flow through said loop and for coding said current to successively poll said identification modules; each of said identification modules further including means for recognizing a poll thereof and for responding by selectively changing the impedance presented to the loop current, said control unit means for recognizing a change in loop potential thus being informed of the responses to the poll of said identification modules.

93. A single-wire loop alarm system in accordance with claim 92 wherein some of said identification modules are responsive to currents in a first direction through said loop and others of said identification modules are responsive to currents in a second direction through said loop, all of said modules simply allowing the loop current to be bypassed if the current is in the direction for which the module is not responsive; said control unit means for causing said relative large current to flow through said loop operates to alternate between the two directions; and said control unit means for polling said identification modules also controls the loop current to alternate between the two directions.

94. A single-wire loop alarm system in accordance with claim 92 wherein said control unit means for recognizing a change in loop potential includes resistance means through which the loop current flows for developing a test potential, programmable comparator means which includes means for representing a programmable threshold level, and means for indicating if said test potential is above or below the represented threshold level.

95. A single-wire loop alarm system in accordance with claim 92 wherein said identification modules are polled by said control unit generating pulse counts, and the means in each identification module for recognizing a poll thereof includes means for recognizing a unique pulse count.

96. A single-wire loop alarm system in accordance with claim 92 further including a plurality of housings, each of said identification modules and its associated alarm switch and resistance being contained in a single housing.

97. An alarm system comprising a plurality of alarm switches and paired identification modules connected in a loop; and a control unit, said control unit including means for transmitting addresses over said loop to all of said identification modules in a polling sequence, for ascertaining status information transmitted back along said loop, and for taking appropriate action in response to such status information; each of said identification modules including means for transmitting the status of its paired alarm switch responsive to the appearance of its address on said loop; said control unit further including means for cyclically displaying the addresses of all identification modules paired with alarm switches whose statuses represent alarm conditions, and switch means for causing said control unit to subsequently ignore the alarm condition of any alarm switch whose address is displayed while said switch means is momentarily operated.

98. An alarm system comprising a plurality of alarm switches and paired identification modules connected in a loop; and a control unit, said control unit including means for transmitting addresses over said loop to all of said identification modules in a polling sequence, for ascertaining status information transmitted back along said loop, and for taking appropriate action in response to such status information; each of said identification modules including means for transmitting the status of its paired alarm switch responsive to the appearance of its address on said loop; said control unit further including manually operated means for triggering the display of the history of the alarm system subsequent to the preceding display, and means responsive to the operation of said manually operated means for cyclically displaying the addresses of all identification modules paired with alarm switches whose statuses represented alarm conditions during preceding polling sequences.

99. An alarm system in acordance with claim 98 wherein said displaying means causes each displayed address to flash a number of times corresponding to the number of times the paired alarm switch was in an alarm condition.

100. An address programmer for an alarm system, said alarm system having a plurality of alarm switches and paired identification modules connected in a single-wire loop; and a control unit, said control unit including means for transmitting addresses over said loop to all of said identification modules in a polling sequence, for ascertaining status information transmitted back along said loop, and for taking appropriate action in response to such status information; each of said identification modules including means responsive to receipt of programming current pulses for setting its address, and means for transmitting on said loop the status of its paired alarm switch responsive to the appearance of its address on said loop during a polling sequence; said address programmer comprising means for representing an address, means connectable across said loop, and means for applying to said loop programming current pulses for setting the address of a selected identification module to be that represented in the programmer.

101. An address programmer in accordance with claim 100 wherein said current pulse applying means includes means for controlling current pulses of a first magnitude for checking the status of the selected identification module and means for controlling current pulses of a second magnitude for setting its address.

102. An address programmer in accordance with claim 101 further including means for cycling said address representing means and said current pulse applying means to set the addresses of a multiplicity of identification modules automatically in succession.

103. An alarm system comprising a plurality of alarm switches and paired identification modules connected in a single-wire loop; and a control unit, said control unit including means for transmitting addresses over said loop to all of said identification modules in a polling sequence, for ascertaining status information transmitted back along said loop, and for taking appropriate action in response to such status information; each of said identification modules including means for transmitting on said loop the status of its paired alarm switch responsive to the appearance of its address on said loop during a polling sequence, and means responsive to the appearance of a control code on said loop for setting the address of the module in accordance with the control code.

104. An alarm system in accordance with claim 103 wherein each of said identification modules responds to current pulses of a first magnitude for transmitting its status and responds to current pulses of a second higher magnitude for setting its address.

105. An identification module comprising means for responding to an assigned address transmitted over a line in which the module is connected, the module including means for powering itself by current flowing in said line, means for counting current pulses in said line and for comparing the number with said assigned address, and means responsive to a predetermined condition on said line following the counting of current pulses for assigning an address to the module which is equal to the pulse count number.

106. An identification module in accordance with claim 105 further including means responsive to the assigning of an address to the module for causing the module to thereafter be immune to any attempts to change the assigned address.

107. An identification module in accordance with claim 106 wherein the assigned address is represented by an N-bit number, each bit of which is assignable, and further including means for assigning an (N+1)th bit to test the address assignability of the module but otherwise unused to distinguish the address of the module from the addresses of all other like modules.

108. An identification module in accordance with claim 105 wherein the assigned address is represented by an N-bit number, each bit of which is assignable, and further including means for assigning an (N+1)th bit to test the address assignability of the module but otherwise unused to distinguish the address of the module from the addresses of all other like modules.

109. A single-wire loop alarm system comprising a central control; a wire loop whose ends terminate at said central control; a plurality of normally-closed alarm switches disposed along said loop; means in said central control for normally causing a fixed current to flow through said loop and the alarm switches disposed therealong; means for registering an alarm condition responsive to the opening of one of said alarm switches; a plurality of identification modules each connected in parallel across a respective alarm switch, having means for representing a unique address, and including means responsive to a transmitted code corresponding to said unique address appearing on the loop when the respective alarm switch is open for responding with an indication of its status; and means in said central control responsive to a change in the loop impedance when an alarm switch is open for polling said modules by applying seqentially on said loop the codes corresponding the the module addresses; each of said modules allowing an alarm condition to be registered in the normal manner even if the module malfunctions and does not respond with an indication of its status when its address appears on the loop.

110. A single-wire loop alarm system comprising a central control; a wire loop whose ends terminate at said central control; a plurality of alarm switches disposed along said loop; means in said central control for normally causing a fixed current to flow through said loop and for measuring the potential drop across said loop; a plurality of identification modules each connected in association with a respective alarm switch, having means for representing a unique address, and including means responsive to a code transmitted from said central control corresponding to said unique address appearing on the loop for responding with an indication of its status; and means in said central control for sensing changes in the loop potential for ascertaining changes in the statuses of said alarm switches and for polling said modules by applying sequentially on said loop the codes corresponding to the module addresses; said means for causing changes in the loop potential including programmable comparator means, means for setting a threshold level in said programmable comparator means, means for determining whether the loop potential is above or below said threshold level, and means for changing said threshold level as a function of small changes in said loop potential which are not large enough to be indicative of a change in status of an alarm switch.

* * * * *